US007520942B2

(12) United States Patent
Klueh et al.

(10) Patent No.: US 7,520,942 B2
(45) Date of Patent: Apr. 21, 2009

(54) NANO-SCALE NITRIDE-PARTICLE-STRENGTHENED HIGH-TEMPERATURE WROUGHT FERRITIC AND MARTENSITIC STEELS

(75) Inventors: Ronald L. Klueh, Knoxville, TN (US); Naoyuki Hashimoto, Knoxville, TN (US); Philip J. Maziasz, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 249 days.

(21) Appl. No.: 10/947,119

(22) Filed: Sep. 22, 2004

(65) Prior Publication Data

US 2006/0060270 A1 Mar. 23, 2006

(51) Int. Cl.
*C22C 38/24* (2006.01)
*C22C 38/46* (2006.01)

(52) U.S. Cl. ..... 148/326; 148/328

(58) Field of Classification Search ..... 148/333–336, 148/325–328, 320, 546, 547, 648, 649, 653, 148/654, 660, 663; 420/66, 70, 104, 109, 420/127, 128

See application file for complete search history.

(56) References Cited

U.S. PATENT DOCUMENTS 5,292,384 A 3/1994 Klueh
5,746,843 A 5/1998 Miyata et al.
6,162,307 A * 12/2000 Hasegawa et al. ..... 148/334
6,254,697 B1 7/2001 Tashiro et al.
6,514,359 B2 * 2/2003 Kawano ..... 148/328
6,966,955 B2 * 11/2005 Choi et al. ..... 148/328

FOREIGN PATENT DOCUMENTS

JP 2001-192761 * 7/2001

OTHER PUBLICATIONS

Computer-generated English translation of Japanese patent 2001-192761, Hasegawa et al., Jul. 17, 2001.*

* cited by examiner

*Primary Examiner*—Deborah Yee
(74) *Attorney, Agent, or Firm*—Scully, Scott, Murphy & Presser, P.C.; Joseph A. Marasco

(57) ABSTRACT

A method of making a steel composition includes the steps of:

a. providing a steel composition that includes up to 15% Cr, up to 3% Mo, up to 4% W, 0.05-1% V, up to 2% Si, up to 3% Mn, up to 10% Co, up to 3% Cu, up to 5% Ni, up to 0.3% C, 0.02-0.3% N, balance iron, wherein the percentages are by total weight of the composition;
b. austenitizing the composition at a temperature in the range of 1000° C. to 1400° C.;
c. cooling the composition of steel to a selected hot-working temperature in the range 500° C. to 1000° C.;
d. hot-working the composition at the selected hot-working temperature;
e. annealing the composition for a time period of up to 10 hours at a temperature in the range of 500° C. to 1000° C.; and
f. cooling the composition to ambient temperature to transform the steel composition to martensite, bainite, ferrite, or a combination of those microstructures.

17 Claims, 37 Drawing Sheets

NANO-SCALE NITRIDE-PARTICLE-STRENGTHENED HIGH-TEMPERATURE WROUGHT FERRITIC AND MARTENSITIC STEELS

The United States Government has rights in this invention pursuant to contract no. DE-AC05-00OR22725 between the United States Department of Energy and UT-Battelle, LLC.

CROSS REFERENCE TO RELATED APPLICATIONS

FIELD OF THE INVENTION

The present invention relates to wrought steels, and more particularly to high-nitrogen transformable steels.

BACKGROUND OF THE INVENTION

Ferritic and martensitic wrought Cr—Mo, Cr—Mo—V, etc. steels, introduced in the 1940s, are preferred structural materials for elevated-temperature applications. For example, such steels are used in many parts of fossil-fired power plants—from boilers to turbines. Moreover, such steels are used extensively in the petrochemical industry. The steels are also used in nuclear fission power plants and are contemplated for use in future fusion reactor plants.

Some major advantages of ferritic and martensitic, normalized-and-tempered and/or quenched-and-tempered, wrought Cr—Mo, Cr—Mo—V, etc. steels include good thermal properties, such as, for example, high thermal conductivity and low expansion coefficient, relative to other high-temperature alloys, such as the austenitic stainless steels. A shortcoming has been high-temperature tensile and creep strength, which places a limit on the upper operating temperature of the steels. This stems from the instability of the as-tempered microstructure, which includes a low-number density of sub-micron-size Cr, Nb, and/or V carbides, nitrides, and/or carbonitrides, but few, if any, nano-scale particles. Upper operating temperatures also depend on oxidation and corrosion resistance, but the higher-chromium steels would be capable of operating at higher temperatures if creep strength were higher.

Examples of early steels of this type were 2¼Cr-1Mo (ASTM Grade 22) and 9Cr-1Mo (ASTM Grade 9), which had upper-use temperatures of about 540° C. New steels have since been introduced for which the operating temperatures were increased. For example, 9Cr-1Mo was modified to produce Grade 91 (nominally Fe-9Cr-1Mo-0.25V-0.07Nb-0.05N-0.1C) by adding vanadium, niobium and nitrogen. As a result of such modifications, the upper-use temperature for steels being used in ultrasupercritical steam plants today is about 620° C. (based on ASME Code approval for pressure-vessel applications).

Currently used power-plant steels were developed based on modified 9Cr-1Mo steel, primarily by substitution of tungsten for some of the molybdenum in modified 9Cr-1Mo, although boron and more nitrogen were also utilized. These steels are typified by: NF616 (ASTM Grade 92) (Fe-9.0Cr-1.8W-0.5Mo-0.20V-0.05Nb-0.45Mn-0.06Si-0.06N-0.004B-0.07C); E911 (Fe-9.0Cr-1.0Mo-1.0W-0.20V-0.08Nb-0.40 Mn-0.40Si-0.07N-0.11C); TB12 (Fe-12.0Cr-0.5Mo-1.8W-1.0Ni-0.20V-0.05Nb-0.50 Mn-0.10Ni-0.06Si-0.06N-0.004B-0.10C); and HCM12A (ASTM Grade 122) (Fe-12.0Cr-0.5Mo-2.0W-1.0Cu-0.25V-0.05Nb-0.30Ni-0.60 Mn-0.10Si-0.06N-0.003B-0.10C). The aforementioned compositions were all developed and introduced commercially in the 1990s for 620° C. operation with a $10^5$ h creep-rupture strength at 600° C. of 140 MPa.

There is a need for high-temperature ferritic and martensitic steels capable of operating at temperatures beyond 620° C. and as high as 650° C. One way that has been suggested to increase the temperature limit to 650° C. and higher and still maintain the inherent advantages of ferritic and martensitic steels (i.e. high thermal conductivity and low thermal expansion) is through the use of oxide dispersion-strengthened (ODS) steels. Elevated temperature strength of ODS steels is obtained through microstructures that contain a high density of small $Y_2O_3$ or $TiO_2$ particles dispersed in a ferrite matrix. Unfortunately, production of ODS steels involves complicated and expensive powder metallurgy and mechanical alloying methods that usually involve extrusion. The directionality in the microstructure deriving from these processing methods generally produces undesirable anisotropic mechanical properties.

There is therefore a need to for high-temperature ferritic or martensitic wrought steels that can be produced by conventional steel processing methods rather than expensive powder metallurgy/mechanical alloying methods. Furthermore, with such a processing technique, it should be easier to produce a non-directional (more uniform) microstructure, which would overcome one of the inherent problems for the ODS steels. There is a need for new steel compositions and processing methods that result in steels that have properties comparable to the best ODS steels at temperatures above 620° C.; such steels would not be processed by powder metallurgy and mechanical alloying methods and thus would not be expected to be handicapped by the microstructural directionality and associated problems inherent in the production of conventional ODS steels.

OBJECTS OF THE INVENTION

Accordingly, objects of the present invention include provision of a wrought steel microstructure with a high number density of nano-sized nitride and/or carbide and/or carbonitride precipitate particles in a martensite (untempered or tempered, depending on whether the steel was untempered or tempered) and/or ferrite matrix. The microstructure provides improved elevated-temperature strength properties over the same steel processed by a conventional normalizing-and-tempering or quenching-and-tempering treatment. Further and other objects of the present invention will become apparent from the description contained herein.

SUMMARY OF THE INVENTION

In accordance with one aspect of the present invention, the foregoing and other objects are achieved by a method of making a steel composition that includes the steps of: providing a steel composition that includes 8.8 to 15% Cr, up to 3% Mo, up to 4% W, 0.05-1% V, up to 2% Si, up to 3% Mn, up to 10% Co, up to 3% Cu, up to 5% Ni, up to 0.3% C, 0.02-0.3% N, balance iron, wherein the percentages are by total weight of the composition; austenitizing the composition at a temperature in the range of 1000° C. to 1400° C.; cooling the composition of steel to a selected hot-working temperature in the range 500° C. to 1000° C.; hot-working the composition at the selected hot-working temperature; annealing the composition for a time period of up to 10 hours at a temperature in the range of 500° C. to 1000° C.; and cooling the composition to ambient temperature to transform the steel composition to martensite, ferrite, or a combination of those microstructures.

In accordance with another aspect of the present invention, a steel composition includes 8.8 to 15% Cr, up to 3% Mo, up to 4% W, 0.05-1% V, up to 2% Si, up to 3% Mn, up to 10% Co, up to 3% Cu, up to 5% Ni, up to 0.3% C, 0.02-0.3% N, balance iron, wherein the percentages are by total weight of the composition, the steel further including martensite, and/or ferrite, the steel composition further including nitrogen-containing precipitate particles in a number density of about $10^{19}$ $m^{-3}$ to about $10^{25}$ $m^{-3}$.

Figure 1A:
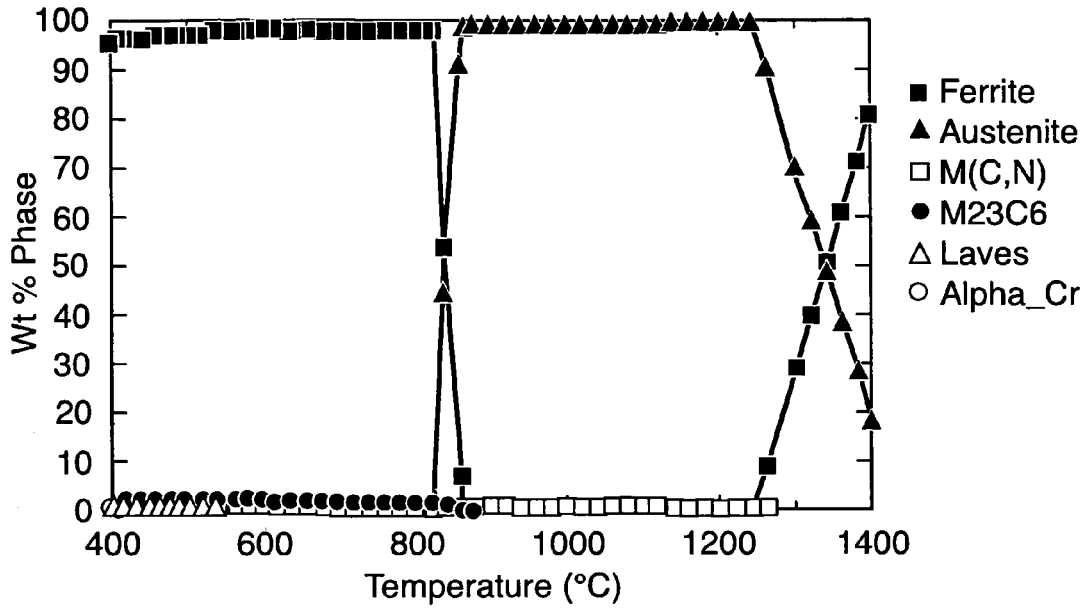
FIG. 1*a* is a graph showing results from a thermodynamic calculation of the equilibrium of all phases in standard modified 9Cr-1Mo steel composition (in wt. %) Fe-0.1C-9.0Cr-0.4Mn-1.0Mo-0.05N-0.08Nb-0.4Si-0.2V.

For a better understanding of the present invention, together with other and further objects, advantages and capabilities thereof, reference is made to the following disclosure and appended claims in connection with the above-described drawings.

DETAILED DESCRIPTION OF THE INVENTION

The present invention relates to the development of nitrogen-containing Cr—Mo—W—V-type ferritic and martensitic steels and to the use of a unique thermo-mechanical treatment (TMT) method on new and known steel compositions to develop dramatically improved mechanical properties. The TMT method in accordance with the present invention produces steels with significantly increased elevated-temperature strength compared to steels having the same amounts of constituents after the conventional normalizing-and-tempering or quenching-and-tempering treatment. The increased strength is the result of producing a new, unique, nano-scale precipitate microstructure containing a high number density of nanometer-sized nitrogen-rich precipitates. The number density of the nitrogen-rich precipitates is in the operable range of $10^{19}$ to $10^{25}$ $m^{-3}$, a preferable range of $10^{20}$ to $10^{24}$ $m^{-3}$, and a more a preferable range of $10^{21}$ to $10^{23}$ $m^{-3}$. Nanometer-sized, for the purposes of the present invention, defines an operable particle-size range of 0.5 to 30 nm, a preferable particle-size range of 0.8 to 20 nm, and a more preferable particle-size range of 1 to 10 nm.

The presence of the nano-scale particles imparts the new steels and nitrogen-containing conventional (commercial) steels with elevated-temperature strengths that are comparable to the best high-strength commercially available ODS steels. Steels with the TMT method in accordance with the present invention are processed by conventional techniques (hot rolling, extrusion, etc.), as opposed to the powder metallurgy/mechanical alloying processes used for ODS steels, often cited as the only way to produce ferritic/martensitic steels for operating temperatures above 620° C.

Steels having various new and known constituent concentrations fall within the scope of the present invention. It is the microstructure of the wrought steels that is critical to the invention. Selection of constituent concentrations depends on the specific intended application of the steel. For example, steels for conventional power-plant applications generally allow for any alloying composition. On the other hand, steels for nuclear applications generally restrict the use of certain alloying elements. Cobalt is not a permitted alloying element in steels designated for use in fission and fusion nuclear plants. Further, for fusion applications, reduced-activation steels are of interest. Such steels eliminate or minimize elements that form long-lived radioactive isotopes during neutron irradiation. Typical alloying elements used in conventional steels that should be eliminated or minimized in reduced-activation steels are molybdenum, niobium, nickel, and copper. To allow for different applications, steel composition ranges will be presented that will allow for all these applications.

New steel compositions can include about 0-15 wt % Cr, about 0-3 wt % Mo, about 0-6 wt % W, 0.05-1 wt % V, 0-2 wt % Si, 0-3 wt % Mn, 0-10 wt % Co, 0-3 wt % Cu, 0-5 wt % Ni, 0-0.3 wt % C, and 0.02-0.3 wt % N, balance Fe. Moreover, the steels may also contain controlled amounts of alloying elements including up to 0.4 wt % Nb, up to 0.4 wt % Ta, up to 0.01 wt % B, up to 0.3 wt % Nd, and/or up to 0.5 wt % Ti. The wide limit on the chromium is allowed for the exploitation of the strength advantages of the new steels at temperatures where the corrosion resistance of high-chromium is not required. New high-strength steels of lower chromium content can be substituted for weaker steel at lower temperatures and provide an economic advantage because of the lesser amount of steel required.

The TMT method in accordance with the present invention can be used to develop improved elevated-temperature strength in nitrogen-containing transformable commercial high-temperature steels of the type with typical compositions in the range of Fe, 5-13 wt % Cr, 0-3 wt % Mo, 0-4 wt % W, 0.1-0.5 wt % V, 0-0.2 wt % Nb, 0-0.25 wt % Ta, 0.02-0.3 wt % N, 0.02-0.25 wt % C and other elements such as Co, Ni, Cu, Si, Mn, B, etc. Examples of such commercial steels include: modified 9Cr-1Mo, HCM12A, NF616, and many others.

The steel compositions of the present invention are transformable into about 100% austenite when annealed above the $A_{C3}$ temperature, the critical temperature above which a steel transforms completely from ferrite to austenite (from the body-centered-cubic structure to the face-centered-cubic structure) during heating, thus allowing for the transformation to martensite and/or ferrite to occur when processed by a new thermo-mechanical treatment (TMT) method described hereinbelow. Moreover, the steel compositions of the present invention are such that essentially all of the precipitates that form in the ferrite/martensite can be dissolved during the austenitization treatment during processing.

Small MX and large $M_{23}C_6$ precipitates are present in conventional 2-13% Cr transformable ferritic and martensitic steels. The small MX particles contribute most to the elevated-temperature strength and have the highest thermal stability; therefore, a steel with a higher number density of fine MX particles should have superior elevated-temperature strength. Moreover, elevated-temperature creep strength will be enhanced if $M_{23}C_6$ is formed as a high number density of small particles, or alternatively, if the amount of $M_{23}C_6$ is minimized. The latter is contemplated to be the better available alternative, as $M_{23}C_6$ has been found to have a minimal effect on elevated-temperature strength of steels in accordance with the present invention. The method of the present invention involves novel modifications to the conventional method used for processing commercial steels containing nitrogen in such a way that MX forms before $M_{23}C_6$ forms, thus making the carbon available for the more desirable MX rather than for less desirable $M_{23}C_6$. Furthermore, the low-carbon compositions described herein contribute compositionally to the minimization of $M_{23}C_6$ formation.

Figure 1B:
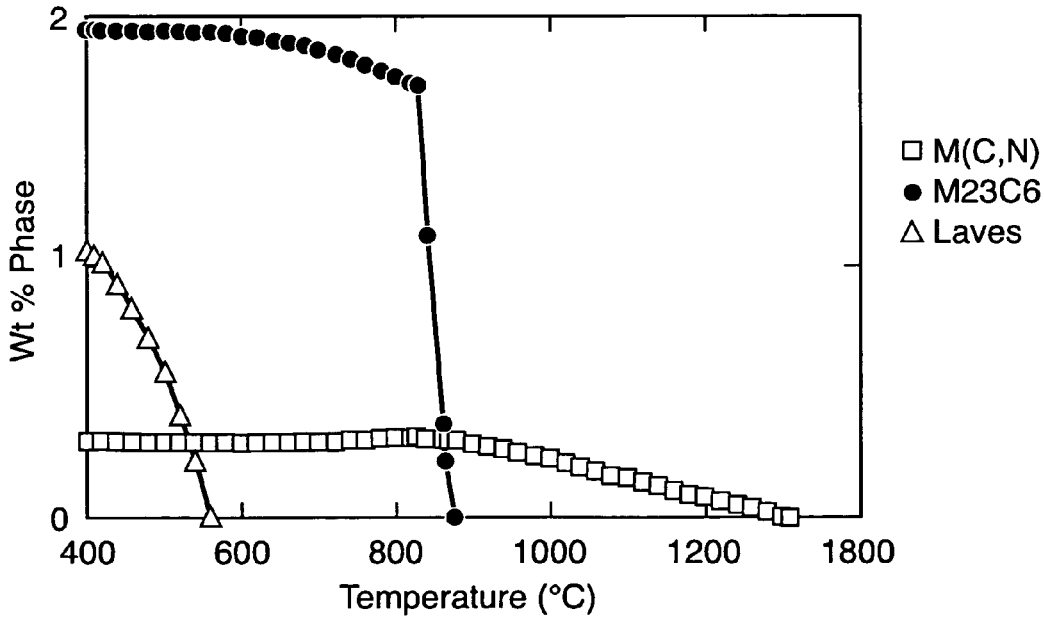
FIG. 1*b* is a graph showing results from a thermodynamic calculation of the important equilibrium precipitate phases in standard modified 9Cr-1Mo steel composition (in wt. %) Fe-0.1C-9.0Cr-0.4Mn-1.0Mo-0.05N-0.08Nb-0.4Si-0.2V.

The JMatPro thermodynamic calculation program (available from Thermotech Ltd./Sente Software Ltd., Surrey Technology Centre, 40 Occam Road, GU2 7YG, United Kingdom) was used to investigate the equilibrium phases expected in the different commercial steels. As shown in FIGS. 1*a*, 1*b* for commercial modified 9Cr-1Mo steel composition, $M_{23}C_6$ makes up almost 2 wt % of the phases below 800° C., which includes the operating temperatures for the steel. However, considerable MX [designated M(C, N) in the JMatPro program] can form, but as stated above, this precipitate forms at a fairly low number density and relatively large particle size in the normalized-and-tempered condition.

Figure 2A:
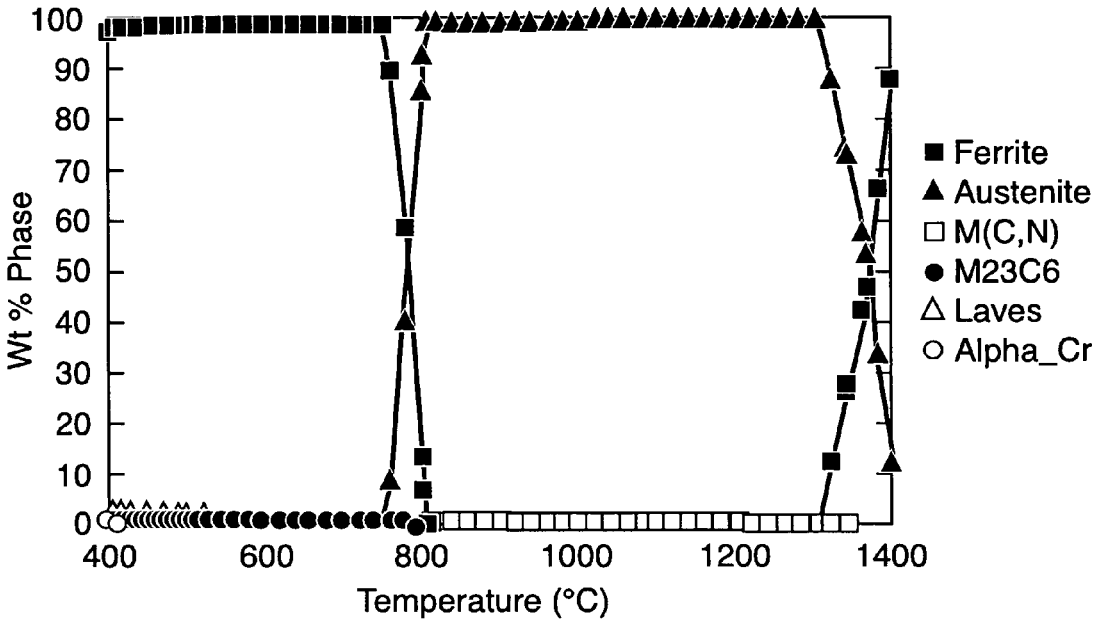
FIG. 2*a* is a graph showing equilibrium of all phases in 9CrMoNiVN steel calculated using the thermodynamic program JMatPro.
Figure 2B:
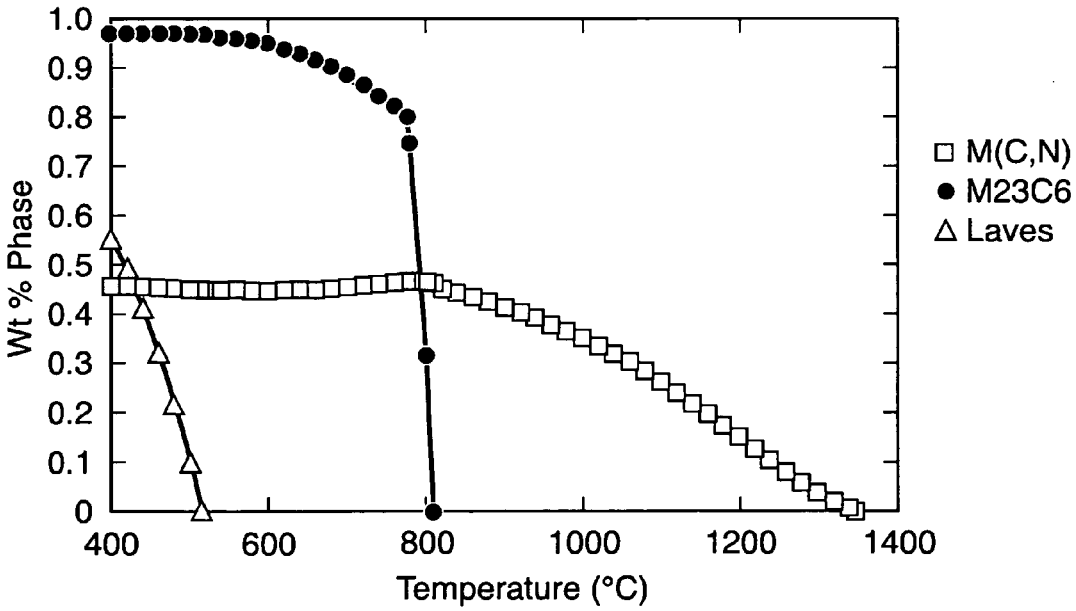
FIG. 2*b* is a graph showing important equilibrium precipitate phases in 9CrMoNiVN steel calculated using the thermodynamic program JMatPro.

As shown in FIGS. 2*a*, 2*b* for a nominal composition of Fe-9Cr-0.5Mo-1.0Ni-0.3V-0.075Nb-0.08N-0.05C, the proportion of MX is increased and the amount of $M_{23}C_6$ is decreased because nitrogen was increased and carbon was decreased from the amounts in modified 9Cr-1Mo steel of FIGS. 1*a*, 1*b*. For increased elevated-temperature strength, the objective is to produce a high number density of fine, nano-sized MX particles. Thermodynamic calculations, such as those shown in FIGS. 2*a*, 2*b*, were used to investigate the TMT processing methods that would produce the favorable MX precipitate microstructure required for improved properties.

The following general TMT method for nitrogen-containing steels produces ferritic and martensitic microstructures containing a high density of fine MX particles that result in improved elevated-temperature strength:

1. The steel is austenitized: The body-centered-cubic ferrite phase (usually martensite) is transformed to face-centered-cubic austenite phase by annealing at a temperature in the range of 1000-1400° C., depending on the composition as determined from the thermodynamic calculations, for a period of time in the range of 1-5 h, depending on section size of steel being processed.

2. The steel is cooled to a temperature in the range of 500-1000° C., hot worked (rolled, extruded, drawn, forged, etc.) at the chosen temperature to form dislocations in the microstructure. The dislocations act as heterogeneous nucleation sites for a distribution of fine vanadium- and/or niobium-rich and/or tantalum-rich, etc. (depending on the composition) MX precipitates (nitrides, carbides, and/or carbonitrides). Hot working the steel to achieve the desired reduction can involve a single pass or multiple passes with intermediate reheating to the hot-working temperature.

3. After completion of the hot-working process (all passes), and before cooling to ambient temperature, the steel is annealed at a temperature in the range of 600-1000° C. for a period of time in the range of 0-10 h to grow the fine precipitate particles to the desired size.

4. The steel is air cooled or quenched in liquid (water or other quenching liquid) to ambient temperature to form a martensite and/or ferrite matrix for the precipitates.

5. (Optional) The steel can be tempered at a temperature in the range of 500-850° C. to improve ductility and toughness.

In order to verify that the compositions and TMT method of the present invention would produce the desired microstructures and improved mechanical properties, experiments were performed on several experimental and commercial compositions that are considered typical. Microstructures of steels processed by the TMT method of the present invention were compared with commercial and experimental steels as normalized-and-tempered—the general conditions wherein such steels are usually put into service. Although the TMT methods of the present invention apply to a broad range of steel compositions, 9-12% Cr steels were considered to be typical examples for comparison.

Normalized-and-Tempered and Quenched-and-Tempered Steels 9-12% Cr transformable ferritic/martensitic steels being considered for replacement by the new steels are usually used in the normalized-and-tempered or quenched-and-tempered condition, which generally results in about 100% tempered martensite microstructure. The general microstructures (for example, prior-austenite grain boundaries, lath/sub-grain boundaries, and precipitates) of most of these steels (e.g., commercial steels used or being considered for use in the power-generation industry, such as modified 9Cr-1Mo, HCM12A, NF616, and E911) are similar. Strengthening mechanisms in the steels generally include solid-solution strengthening, dislocation-particle interactions, dislocation-dislocation interactions, and dislocation-boundary interactions.

In conventional normalized-and-tempered or quenched-and-tempered Cr—Mo—V—Nb type steels, the tempered martensite laths (elongated subgrains with a typical average width of 0.25-0.5 μm) within the prior-austenite grains contain a relatively high dislocation density ($10^{13}$-$10^{14}$ $m^{-2}$), the density depending on the tempering conditions. The dominant precipitates are large (60-200 mm) $M_{23}C_6$ particles that are mainly on lath boundaries and prior-austenite grain boundaries. If V and/or Nb are present in the composition, there will usually also be a fine distribution of small (20-80 nm) MX particles, with the M rich in vanadium and/or niobium, and the precipitates are basically vanadium nitrides and/or vanadium carbonitrides and niobium carbides and/or niobium carbonitrides. Small amounts of $M_2X$ (high chromium, high nitrogen) are found in some cases.

Figure 3B:
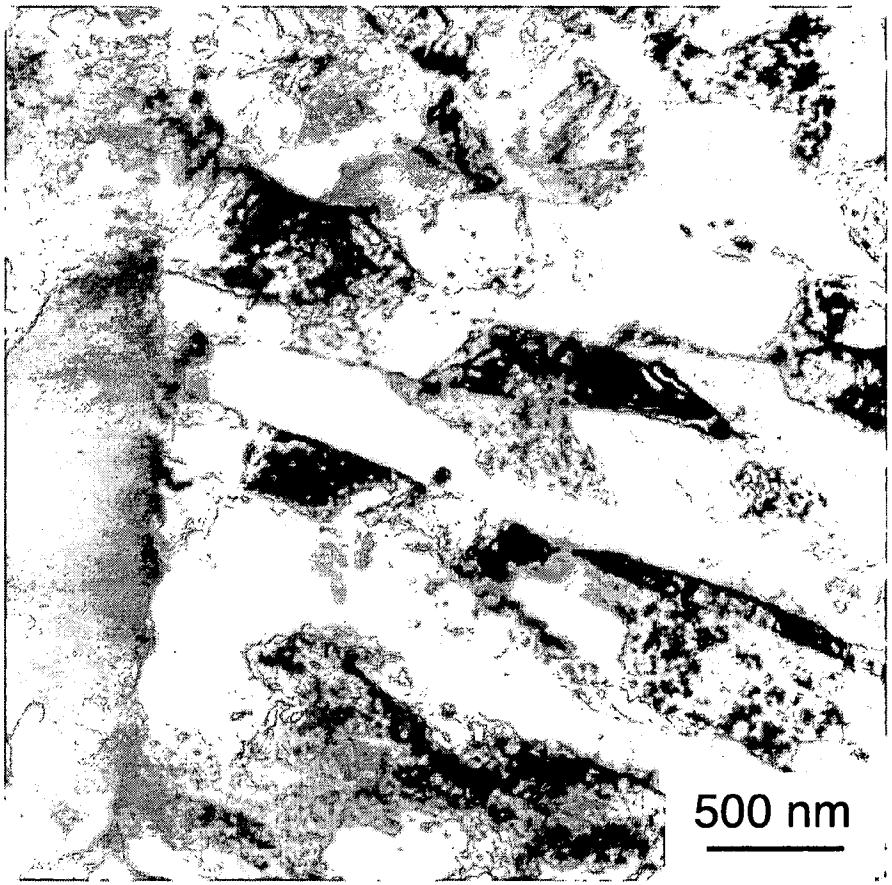
FIG. 3*b* is a transmission electron microscopy (TEM) photomicrograph of normalized-and-tempered modified 9Cr-1Mo steel.
Figure 3A:
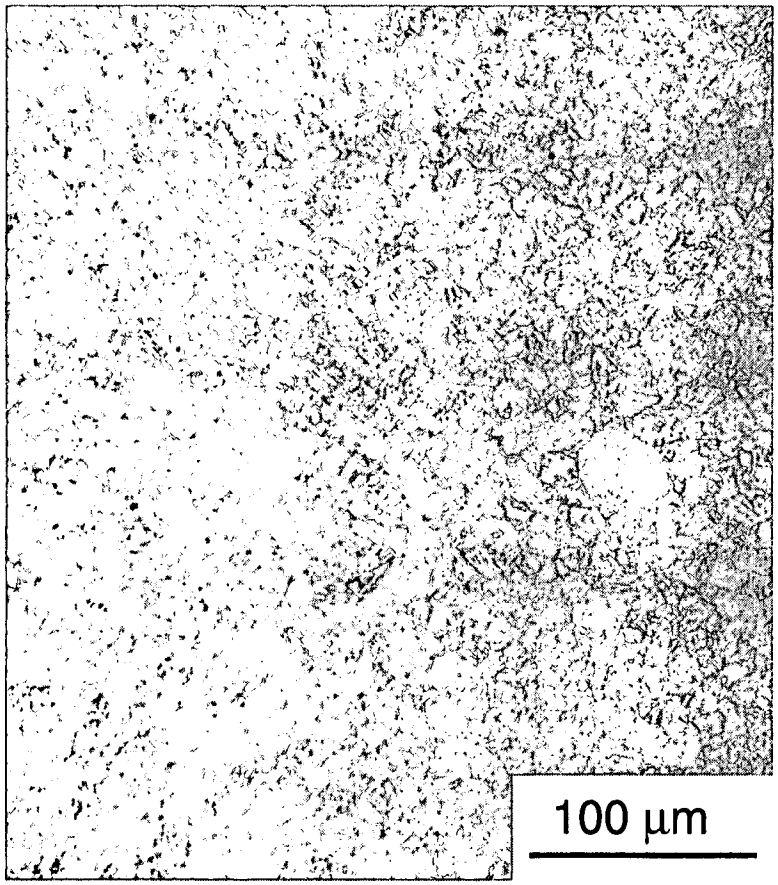
FIG. 3*a* is an optical photomicrograph of normalized-and-tempered modified 9Cr-1Mo steel.
Figure 3D:
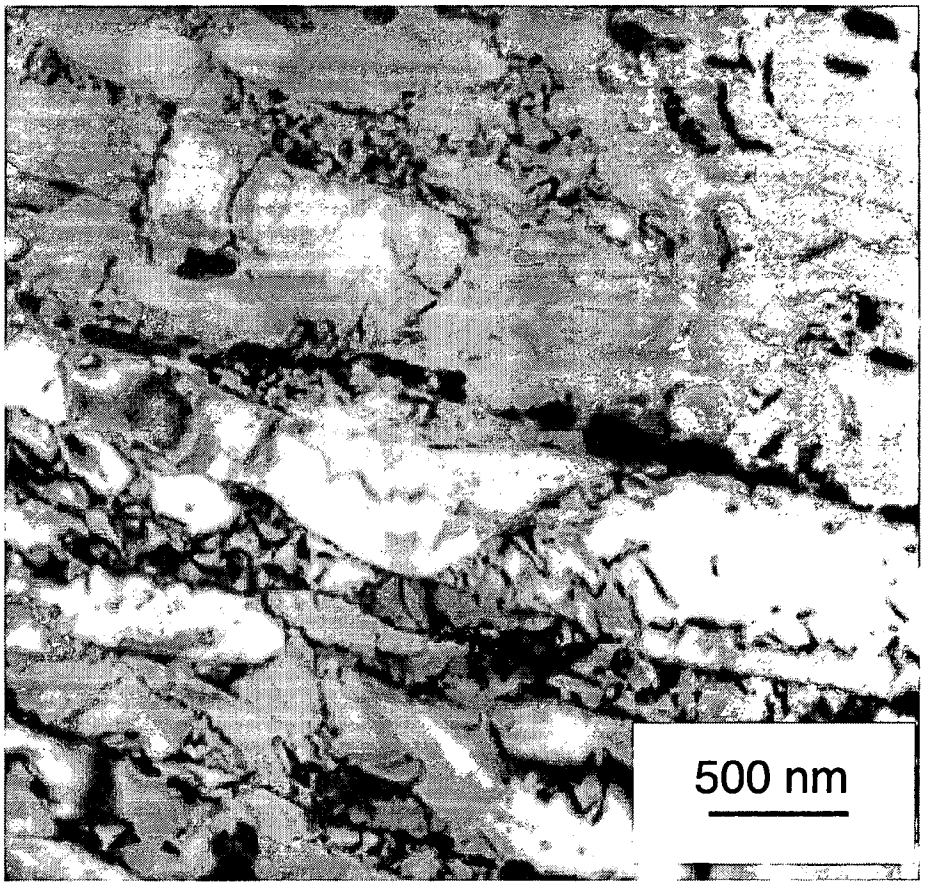
FIG. 3*d* is a TEM photomicrograph of normalized-and-tempered HCM12A steel.
Figure 3C:
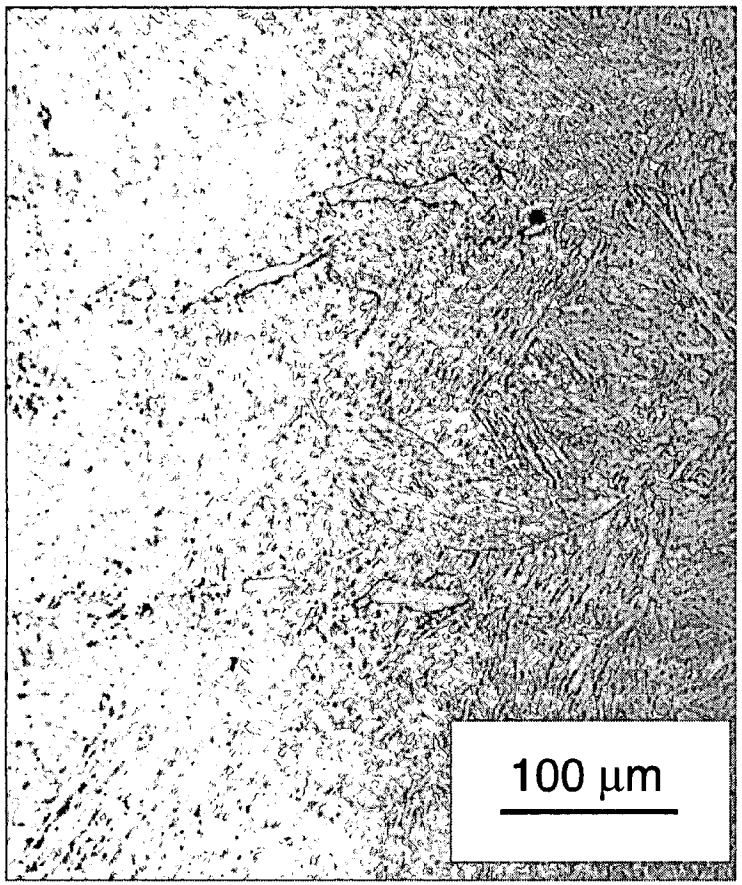
FIG. 3*c* is an optical photomicrograph of normalized-and-tempered HCM12A steel.
Figure 4B:
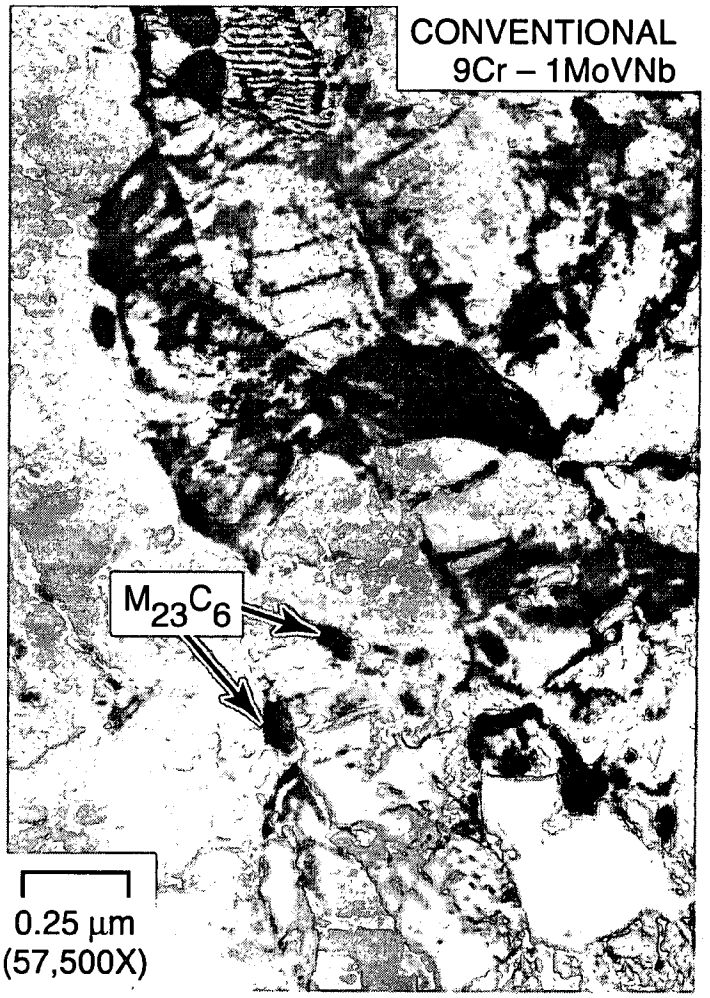
FIG. 4*b* is a TEM photomicrograph of commercial modified 9Cr-1Mo steel showing the microstructure in the normalized-and-tempered condition.
Figure 4A:
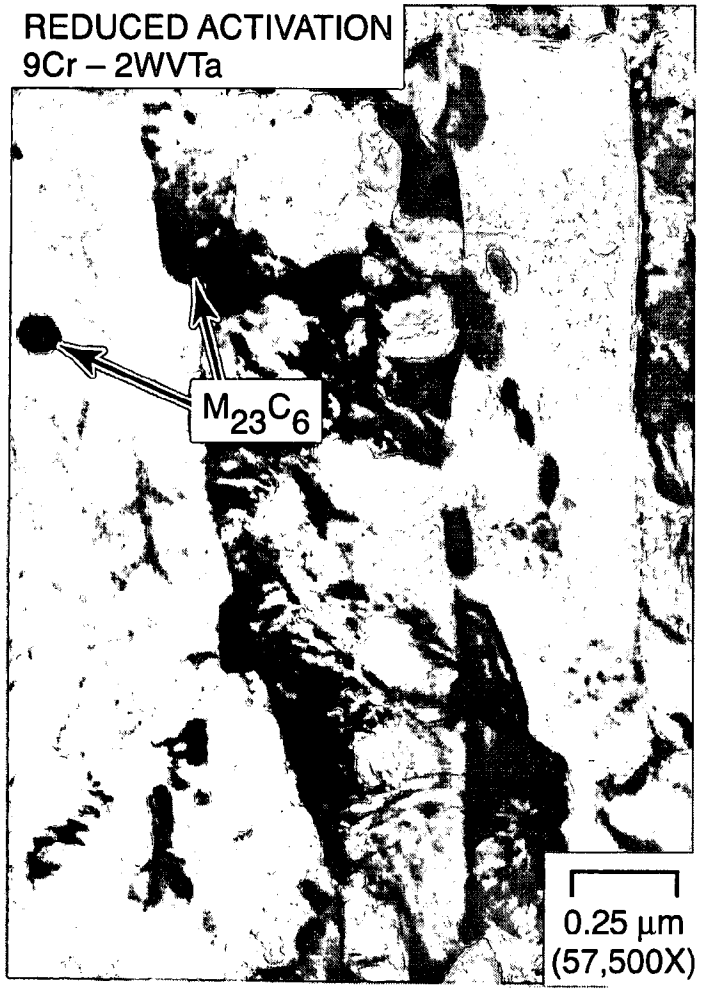
FIG. 4*a* is a TEM photomicrograph of reduced-activation 9Cr-2WVTa steel showing the microstructure in the normalized-and-tempered condition.

FIGS. 3*a*, 3*b*, respectively show optical and transmission electron microscopy (TEM) microstructures of normalized-and-tempered commercial modified 9Cr-1Mo steel; FIGS. 3*c*, 3*d* respectively show similar views of commercial HCM12A. FIGS. 4*a*, 4*b* show the similarity of normalized-and-tempered, reduced-activation 9Cr-2WVTa (nominally Fe-9.0Cr-2.0W-0.25V-0.07Ta-0.1C) (FIG. 4*a*) and modified 9Cr-1Mo (FIG. 4*b*) steel microstructures. For these steels, average particle size and number density of $M_{23}C_6$ precipitates appear to be about 130-150 nm and 3-6×$10^{19}$ $m^{-3}$, respectively, and for MX, they appear to be about 30 nm and 7-8×$10^{18}$ $m^{-3}$, respectively. These microstructures are representative of the class of commercial 9-12% Cr steels (e.g., NF616, HCM12A, E911, etc.) used in the power-generation and petrochemical industries.

EXAMPLE I

New steel compositions were produced by TMT in accordance with the present invention. Table I below lists some compositions that were prepared as ≈450-g (1-lb) vacuum-arc and 6.8 kg (15-lb) melts that were cast into ≈12×25×152 mm (0.5×1.0×6 inch) and ≈25×100×152 mm (1×4×6 inch) ingots, respectively.

TABLE I

| Steel | C | Mn | Ni | Cr | Mo | W | V | Nb | Ta | $N_{Anl}$[a] | $N_{Add}$[b] |
|---|---|---|---|---|---|---|---|---|---|---|---|
| 9Cr—MoNiVNbN[c] | 0.05 | 0.07 | 1.0 | 9.14 | 0.51 | 0.09 | 0.30 | 0.075 | — | 0.042 | 0.08[d] |
| 9Cr—MoNiVNbN2[c] | 0.04 | 0.06 | 1.0 | 9.11 | 0.51 | 0.10 | 0.30 | 0.077 | — | 0.028 | 0.12[d] |
| 9Cr—MoNiVNbN3[c] | 0.05 | 0.06 | 1.0 | 9.11 | 0.52 | 0.08 | 0.30 | 0.075 | — | 0.029 | 0.08[e] |
| 9Cr—MoNiVNbN4[c] | 0.05 | 0.07 | 0.99 | 9.05 | 0.51 | 0.04 | 0.31 | 0.068 | — | 0.035 | 0.08[e] |
| 9Cr—MoNiVNbN5[c] | 0.03 | 0.07 | 1.05 | 9.50 | 0.58 | 0.21 | 0.31 | 0.073 | — | 0.065 | 0.16[e] |
| 9Cr—MoNiVNbN7[g] | 0.08 | 0.77 | 1.0 | 8.89 | 0.52 | <0.01 | 0.31 | 0.067 | | 0.11 | 0.16[e] |
| 9Cr—MoNiVN[f] | 0.02 | 0.44 | 0.99 | 8.88 | 0.51 | <0.01 | 0.30 | <0.01 | — | 0.12 | — |
| 9Cr—WNiVTaN[g] | 0.09 | 1.12 | 1.0 | 9.16 | <0.01 | 0.90 | 0.29 | 0.004 | 0.12 | 0.065 | 0.08[e] |

Table I footnotes:
[a]Analyzed nitrogen concentration.
[b]Amount of nitrogen added to melt.
[c]Vacuum-arc-melted ingot of ≈400 g of size ≈12 × 25 × 152 mm.
[d]Nitrogen added as iron nitride.
[e]Nitrogen added as a chromium-nitrogen master alloy.
[f]Induction-melted ingot ≈6.8 kg of size ≈25 × 100 × 152 mm; melted in 1 atm N.
[g]Air-induction-melted ingot ≈6.8 kg of size ≈25 × 100 × 152 mm.

A difficulty encountered with the melting technique of these heats of the new compositions was that it was not possible, for many compositions, to achieve the amount of nitrogen desired with available melting facilities. However, a range of nitrogen compositions was achieved around the desired value of 0.08% N. Conventional methods are available that allow for the necessary control of nitrogen concentrations, as demonstrated hereinbelow in Example II.

To determine the TMT conditions, the equilibrium microstructures were calculated for different compositions using the computational thermodynamic program JMatPro. An example of such a calculation is shown in FIGS. 2*a*, 2*b* for an Fe-9Cr-1Ni-0.5Mo-0.1W-0.3V-0.075Nb-0.08N-0.05C, which is similar to the steel designated 9Cr—MoNiVN in Table I. Nickel is present in the composition because the objective is to produce a low-carbon (no more than about 0.05% C) steel, and the nickel is required as an austenite stabilizer to make up for the austenite stabilization lost due to the reduction of the carbon from the 0.1% typical of 9Cr martensitic steels. Cobalt, manganese, and copper can be used as an alternative for some or all of the nickel.

The ≈12×25×152 mm vacuum arc-melted ingots and the ≈25×100×152 mm ingots shown in Table I were subjected to a TMT in accordance with steps 1-4 of the five-step process described hereinabove. The steels were hot rolled 20-60% in the range 600-1000° C. with intermediate reheats between rolling passes to bring the plates back to the hot-rolling temperature. Selected steels were subsequently tempered in accordance with step 5.

The objective was to hot roll the steel ingots in the austenite phase; therefore it was necessary to encapsulate the small ingots (about 12×25×152 mm) inside larger plates to keep the ingots from cooling to a deleteriously low temperature during the hot-working process. The large ingots (about 25×100×152 mm) were not encapsulated. Although it is desired to work the steel in the austenite region, the hot-working temperature will not necessarily be above the $A_{r1}$—the critical temperature below which austenite transforms to ferrite on cooling. This is because at temperatures just below $A_{r1}$, there is an incubation period before the transformation occurs. Hot-working and annealing in the austenite phase will enable the steel to transform to martensite when cooled, although this is not necessary, because, as shown below, a high number density of nano-scale precipitates can also form in polygonal ferrite that forms during the TMT method of the present invention under conditions wherein the TMT is applied below $A_{r1}$ and the time to complete the TMT exceeds the incubation period.

Microstructure

Figure 5:
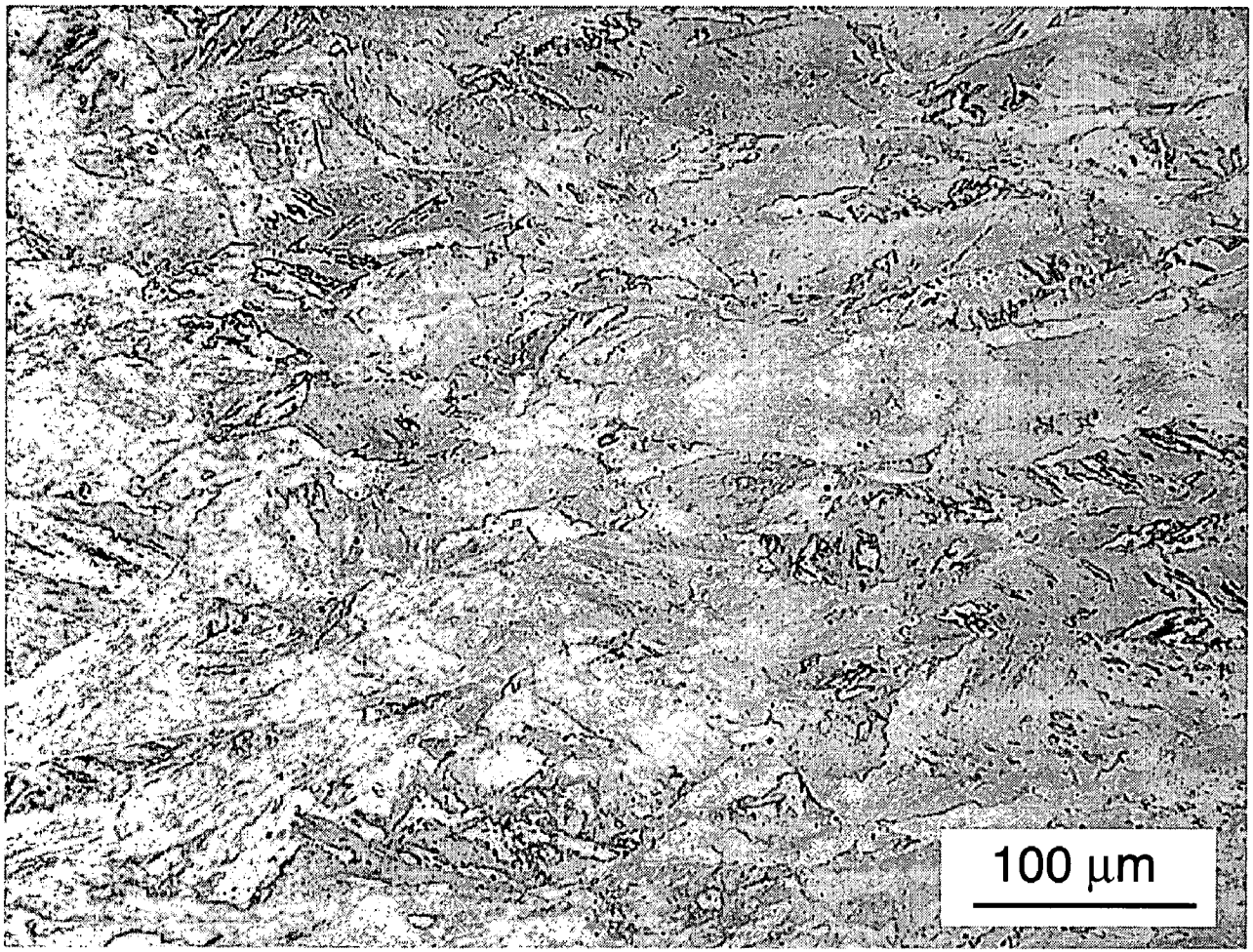
FIG. 5 is an optical photomicrograph of a longitudinal view of 9Cr—MoNiVNbN steel after hot rolling and annealing.

When the optical microstructures of 9Cr-1MoVN and 9Cr-1MoVN2 were first examined (see FIG. 5) after the TMT processing, it appeared they were entirely martensite (the as-cast structure also appeared to be all martensite). However, on closer examination, some ferrite was observed in the microstructure, primarily on prior-austenite grain boundaries). This was especially true when the longitudinal cross section was examined, as opposed to the transverse section. The microstructure of 9Cr—MoVN and 9Cr—MoVN2 appeared to be quite similar.

Figure 6B:
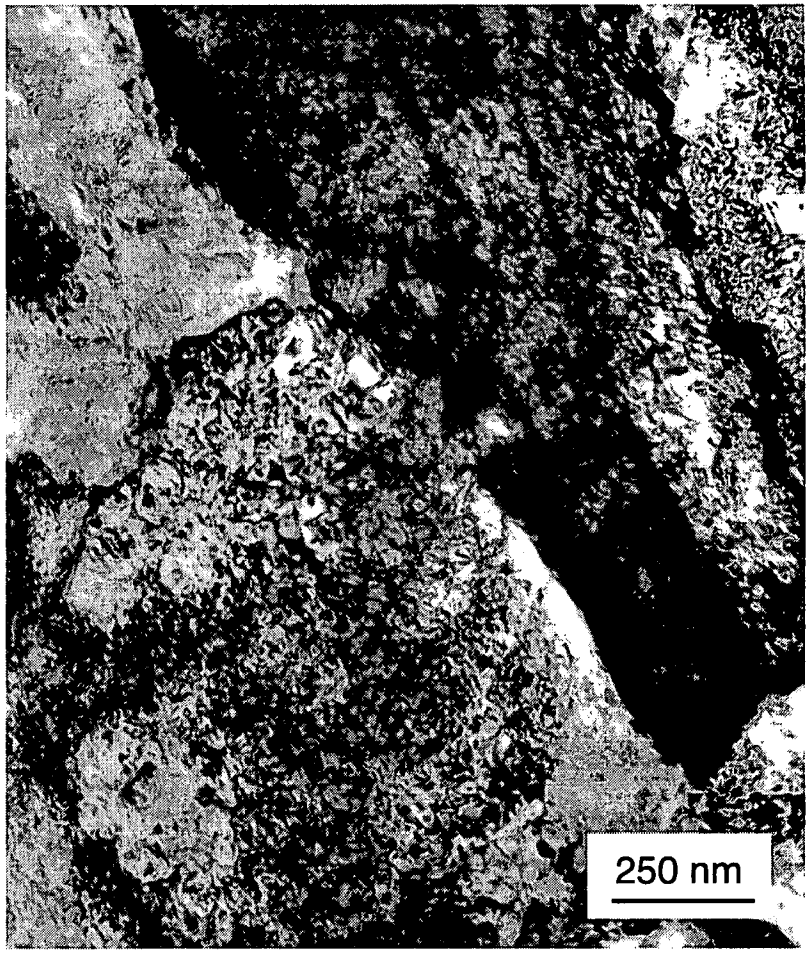
FIG. 6*b* is a portion of the TEM photomicrograph shown in FIG. 6*a* at a greater magnification.
Figure 6A:
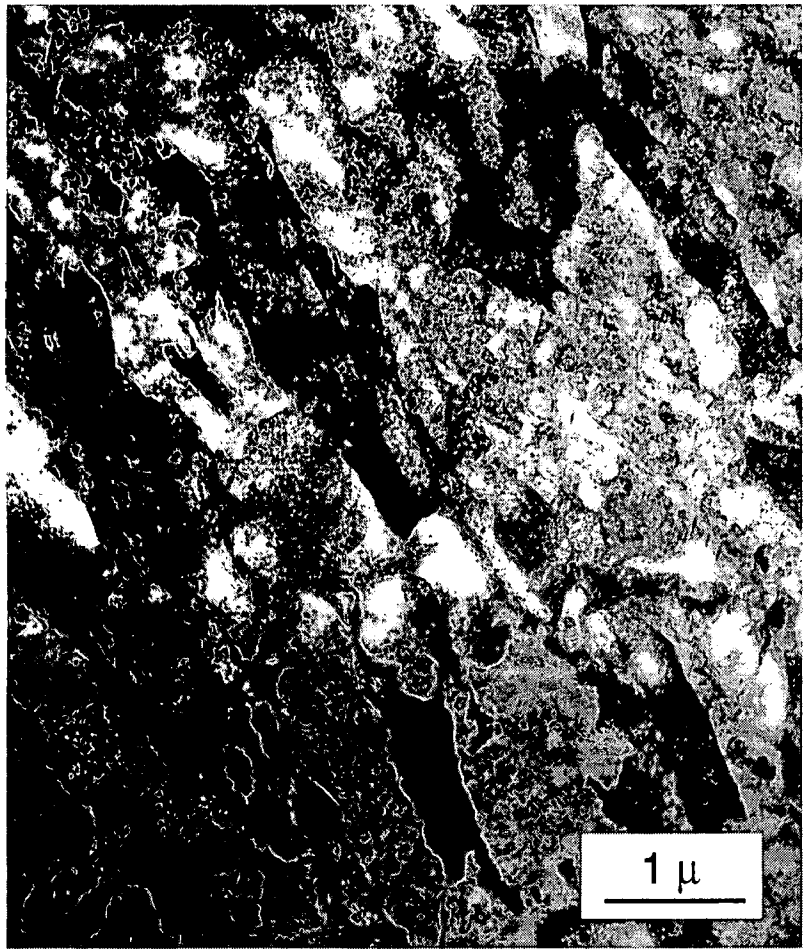
FIG. 6*a* is a TEM showing fine precipitates in martensite in 9Cr—MoNiVNbN steel after hot rolling and annealing.
Figure 7B:
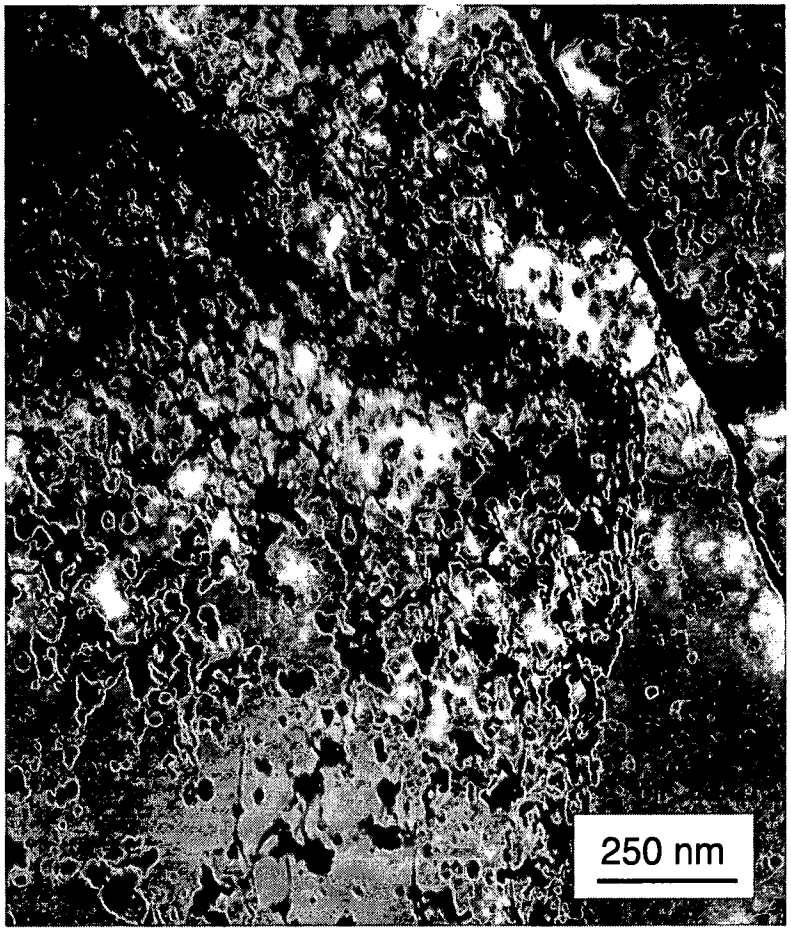
FIG. 7*b* is a portion of the TEM photomicrograph shown in FIG. 7*a* at a greater magnification.
Figure 7A:
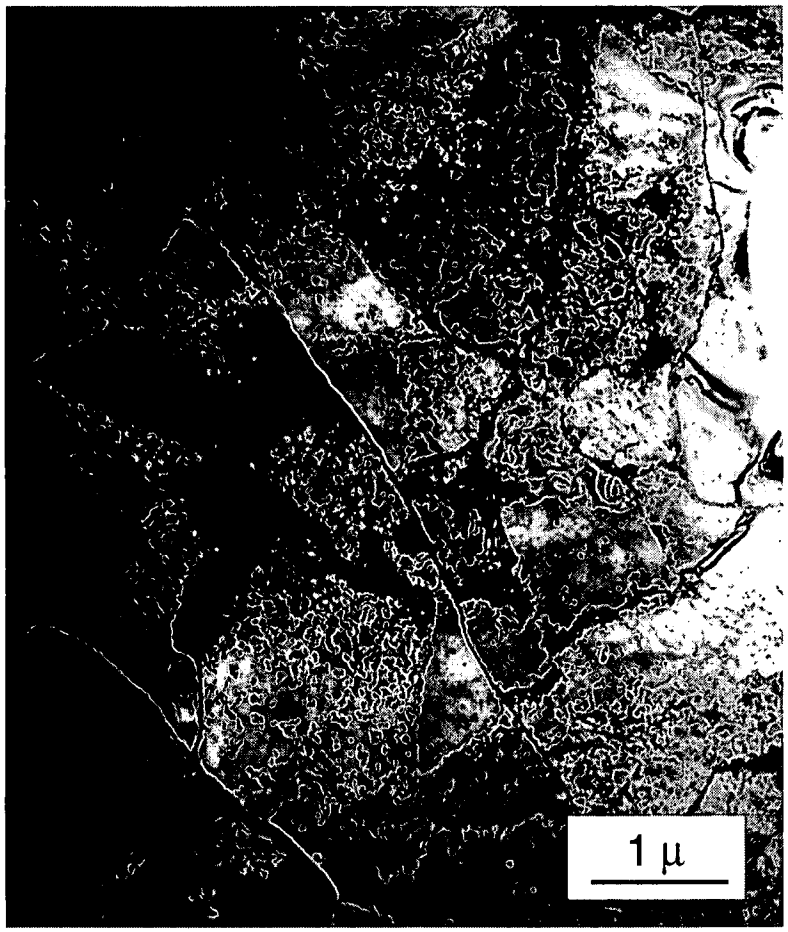
FIG. 7*a* is a TEM photomicrograph showing fine precipitates in polygonal ferrite in 9Cr—MoNiVNbN steel after hot rolling and annealing.

TEM indicated that most of the microstructure was martensite in 9Cr-1MoVN (see FIGS. 6*a*, 6*b*) and 9Cr-1MoVN2 steels. The presence of ferrite was also verified (see FIGS. 7*a*, 7*b*), and it was concluded that it was polygonal ferrite formed during the annealing step after the hot rolling, since this ferrite contained a high number density of fine precipitates, which should not be present in δ-ferrite, which would have to form during austenitization, as shown in FIGS. 2*a*, 2*b*. The precipitates in the ferrite in the two steels were much easier to distinguish than in the martensite, where the precipitates were obscured by the high dislocation density. If δ-ferrite was present, it was there in minor quantities and was not detected by TEM.

Figure 8:
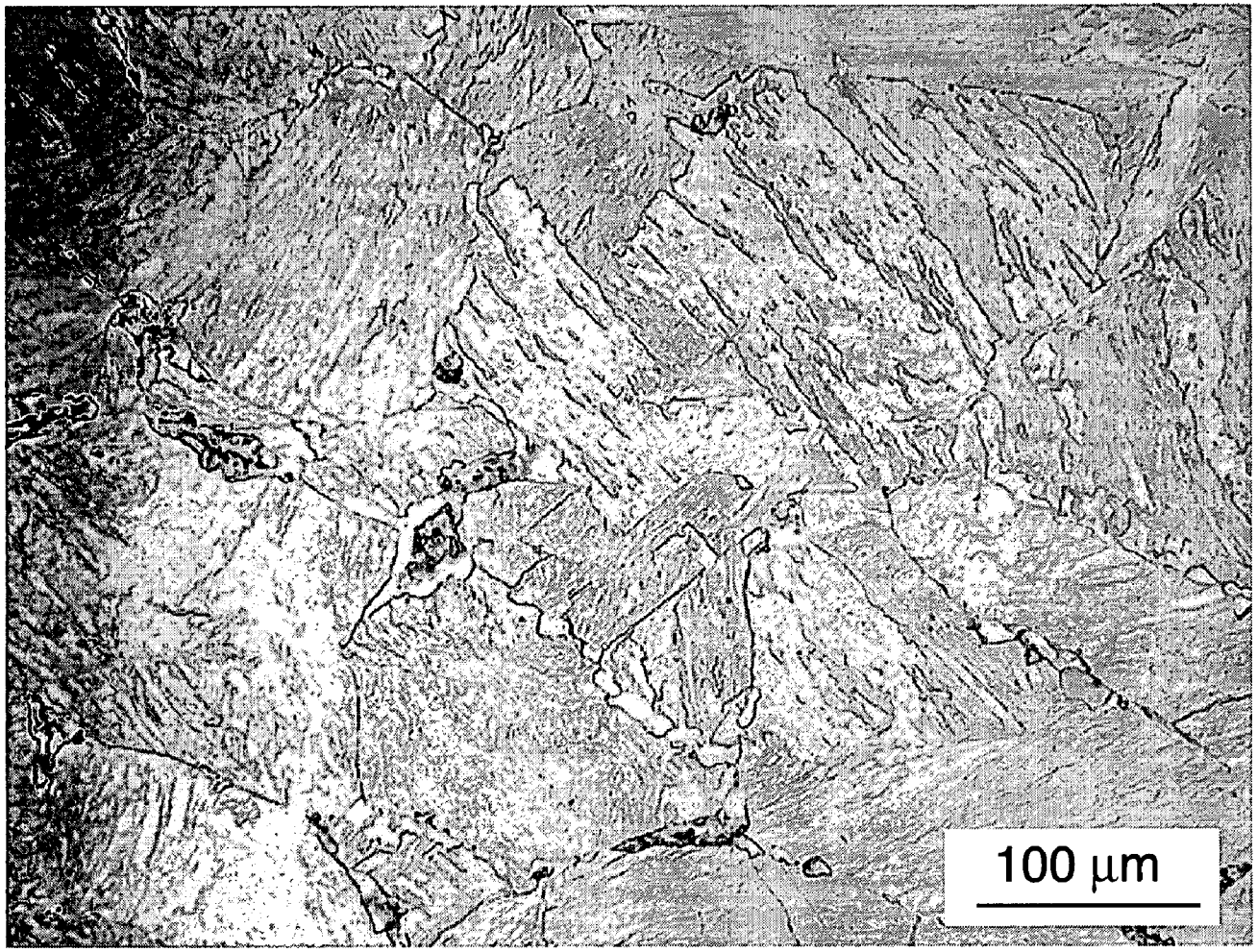
FIG. 8 is an optical photomicrograph of 9Cr—MoNiVNbN3 steel after hot rolling and annealing showing second phase particles in prior-austenite grain boundaries.
Figure 9B:
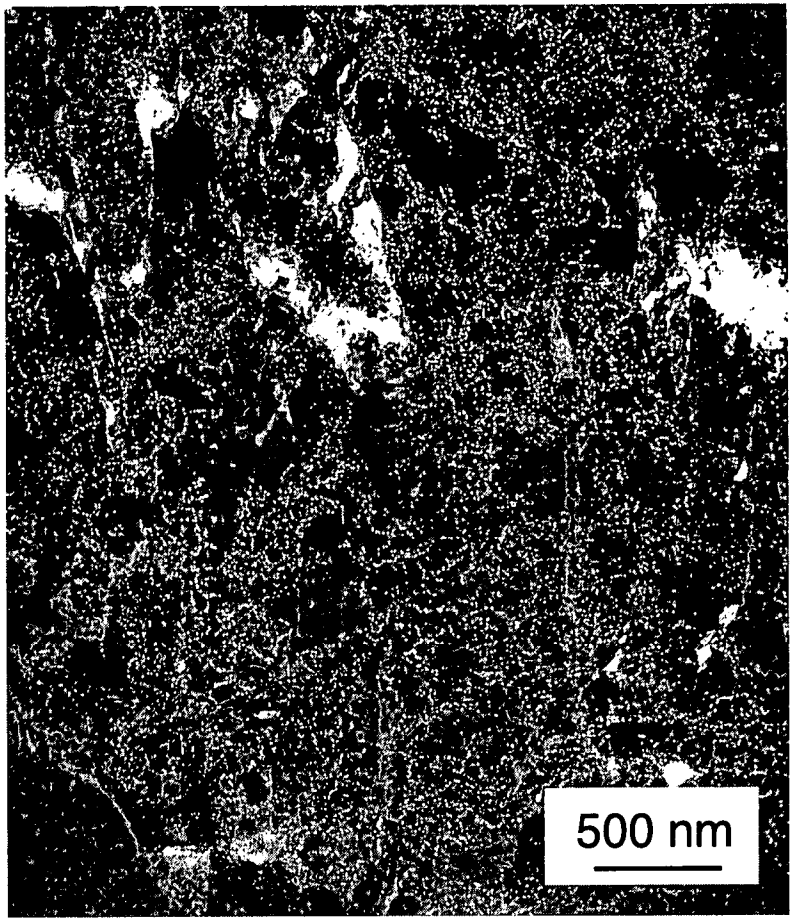
FIG. 9*b* is a dark field TEM photomicrograph of microstructure of 9Cr—MoNiVNbN5 steel after hot rolling and annealing.
Figure 9A:
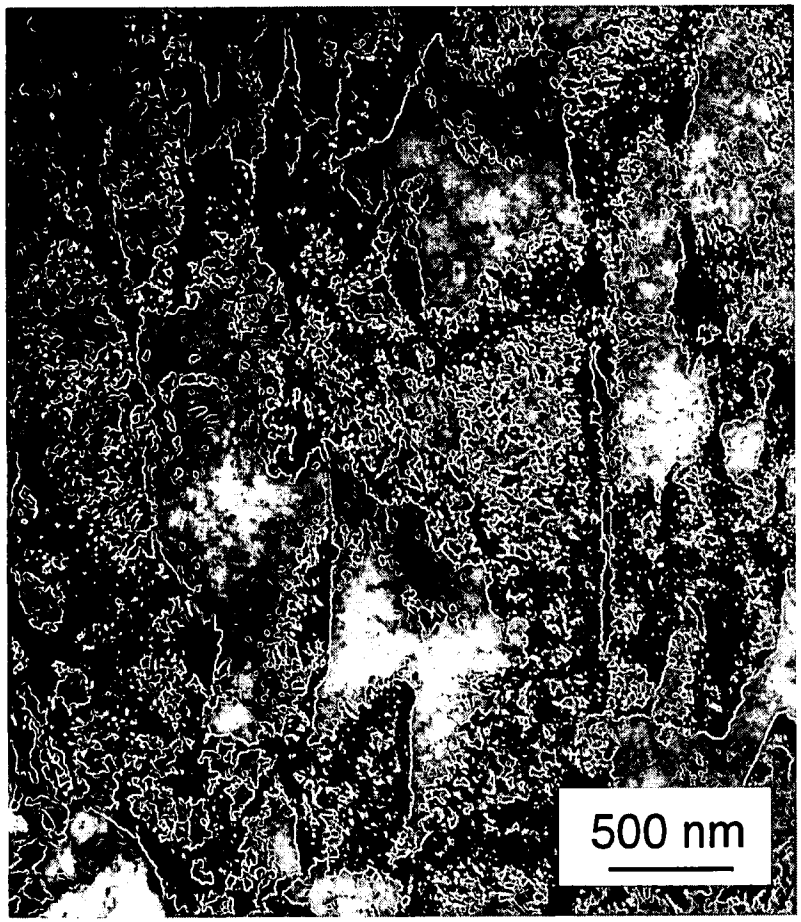
FIG. 9*a* is a bright field TEM photomicrograph of microstructure of 9Cr—MoNiVNbN5 steel after hot rolling and annealing.
Figure 10B:
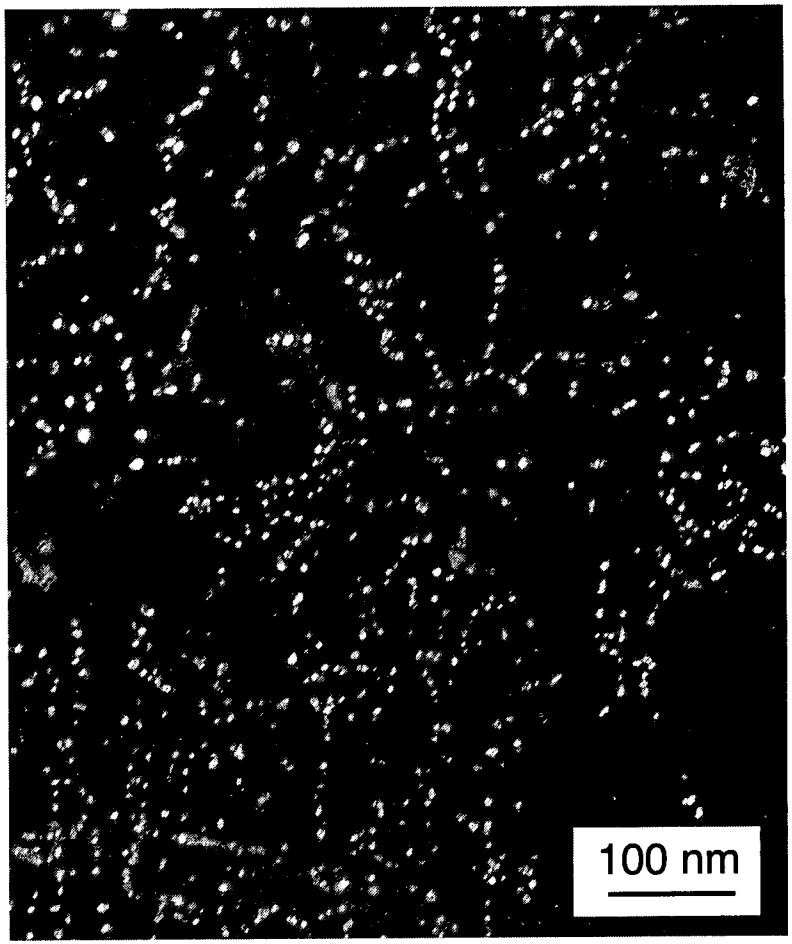
FIG. 10*b* is a high-magnification dark field TEM photomicrograph of 9Cr-1MoVN5 steel after hot rolling and annealing.
Figure 10A:
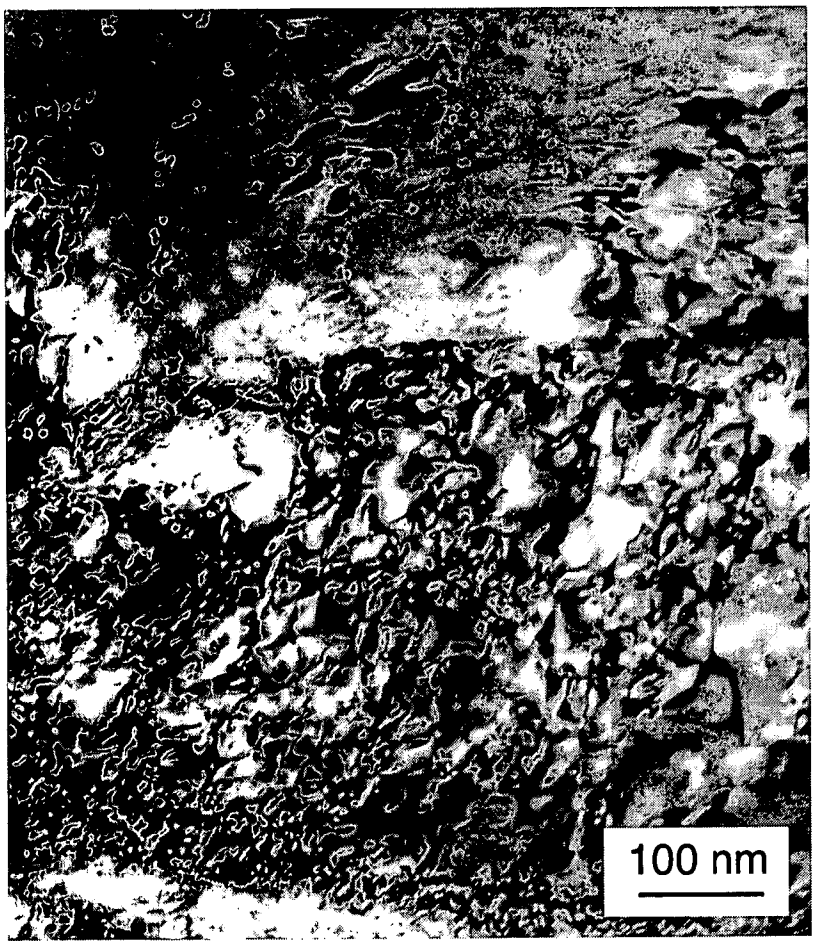
FIG. 10*a* is a high-magnification bright field TEM photomicrograph of 9Cr-1MoVN5 steel after hot rolling and annealing.

The optical microstructures of 9Cr-1MoVN3, 9Cr-1MoVN4, and 9Cr-1MoVN5 were examined after the austenitization, hot rolling, and annealing, and they were found to be mostly martensite. There appeared to be a small amount of another phase in 9Cr-1MoVN3, which was mainly detected along prior-austenite grain boundaries (see FIG. 8). Much less of a similar phase is present in 9Cr-1MoVN4, and 9Cr-1MoVN5 steels. Because it is along prior-austenite grain boundaries, it is believed to be polygonal ferrite formed during the TMT (likely during the anneal following completion of hot rolling).

The TEM of 9Cr-1MoVN3, 9Cr-1MoVN4, and 9Cr-1MoVN5 verified that most of the microstructure of these steels was martensite, in agreement with the optical microscopy. The first time they were examined, no precipitates were seen. On a subsequent examination, extremely fine precipitates were detected by electron diffraction, and although the precipitates were then observed in bright field at high magnification, dark field (bright particles are from precipitate phase diffraction spot) examination provided the best indication of the precipitates. Of these three steels, 9Cr-1MoVN5 contained the highest nitrogen concentration, and it also appeared to contain the highest number density of nano-scale precipitates (see FIGS. 9*a*, 9*b*, 10*a*, 10*b*). However, both of the other steels also contained precipitates, but the number density decreased with decreasing nitrogen, with the fewest precipitates appearing in 9Cr-1MoVN3. 9Cr—WNiVTaN steel also had very fine precipitates, similar to those of 9Cr—MoNiVNbN5.

Figure 11A:
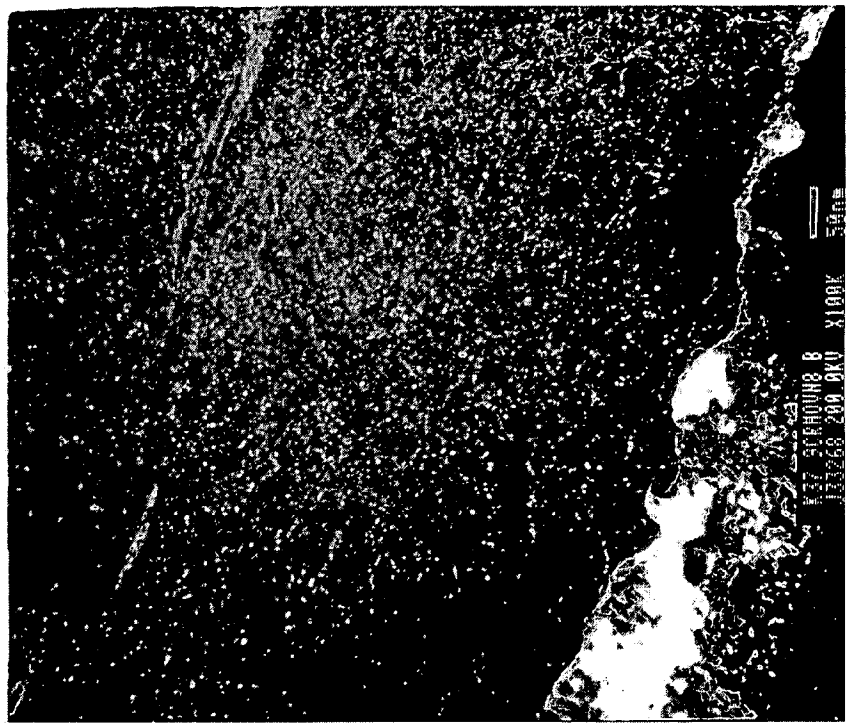
FIG. 11*a* is a bright field TEM photomicrograph of 9CrMoNiVN8 steel after hot rolling and annealing.
Figure 11B:
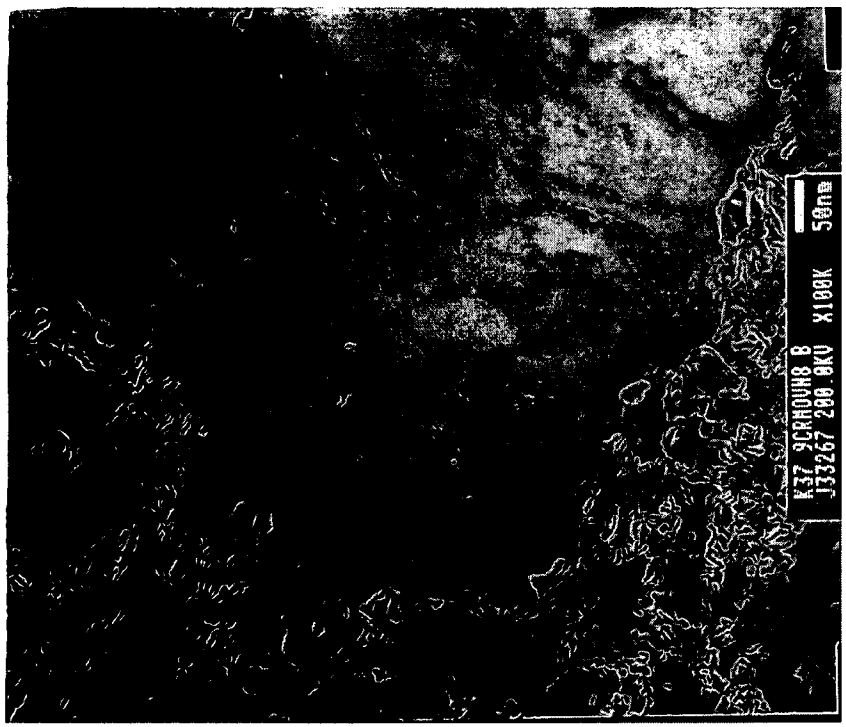
FIG. 11*b* is a dark field TEM photomicrograph of 9CrMoNiVN8 steel after hot rolling and annealing.

Moreover, the microstructure of 9Cr—MoNiVN8 (no niobium or tantalum) with 0.12% N produced by melting in a nitrogen atmosphere had a very high number density of nano-scale precipitates that were only easily visible by dark-field TEM (see FIGS. 11*a*, 11*b*).

Figure 12B:
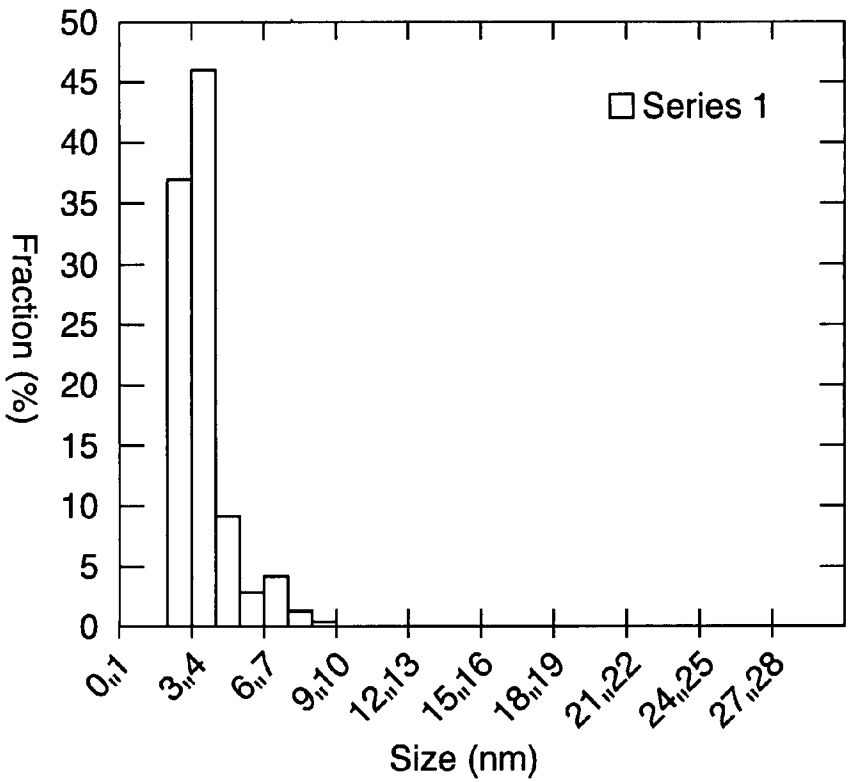
FIG. 12*b* is a graph showing size distribution of fine precipitate particles in 9Cr-1MoVN5 steel.
Figure 12A:
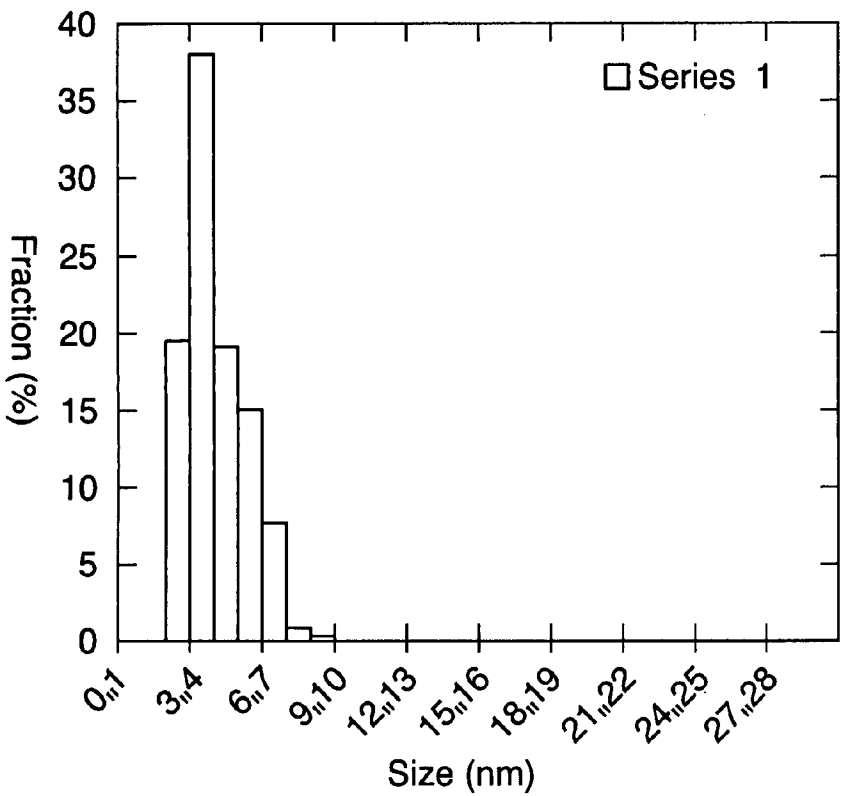
FIG. 12*a* is a graph showing size distribution of fine precipitate particles in 9Cr-1MoVN4 steel.

The number density and average size of the particles were determined for 9Cr-1MoVN4, and 9Cr-1MoVN5 steels as $\approx 1.0\times10^{22}$ $m^{-3}$, 4.0 nm and $7.2\times10^{22}$ $m^{-3}$, 3.3 nm, respectively. FIGS. 12*a*, 12*b* show the size distribution of particles for these two steels, and the relatively small variation in size of the particles is seen. For modified 9Cr-1Mo steel in the normalized-and-tempered condition, MX precipitates are estimated to be an order of magnitude larger at 32 nm. The new steels also have an up to four orders of magnitude (10,000 times) larger number density—estimated at $7.9\times10^{18}$ $m^{-3}$ for normalized-and-tempered modified 9Cr-1Mo.

Mechanical Properties

Figure 13:
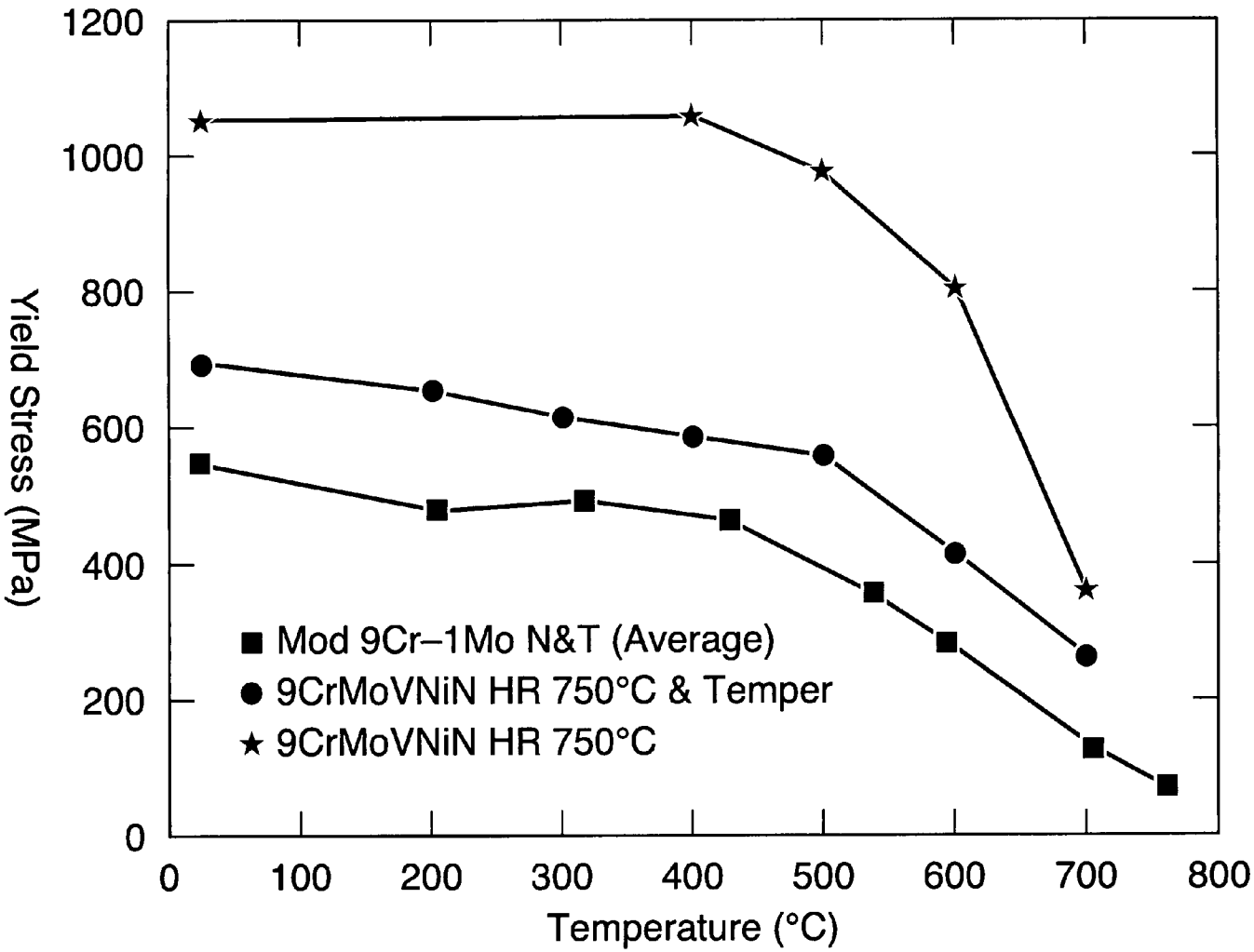
FIG. 13 is a graph showing yield stress of 9Cr—MoNiVN steel in hot-rolled/annealed and hot-rolled/annealed-and-tempered conditions compared to normalized-and-tempered modified 9Cr-1Mo steel.

Tensile properties were determined on some of the new steels. The yield stress of 9Cr—MoNiVNbN steel in both the hot-rolled/annealed condition and the hot-rolled/annealed-and-tempered conditions were significant improvements over the normalized-and-tempered conventional modified 9Cr-1Mo steel (see FIG. 13). The normalized-and-tempered reduced-activation 9Cr-2WVTa steel properties are similar to those of modified 9Cr-1Mo steel.

Figure 14:
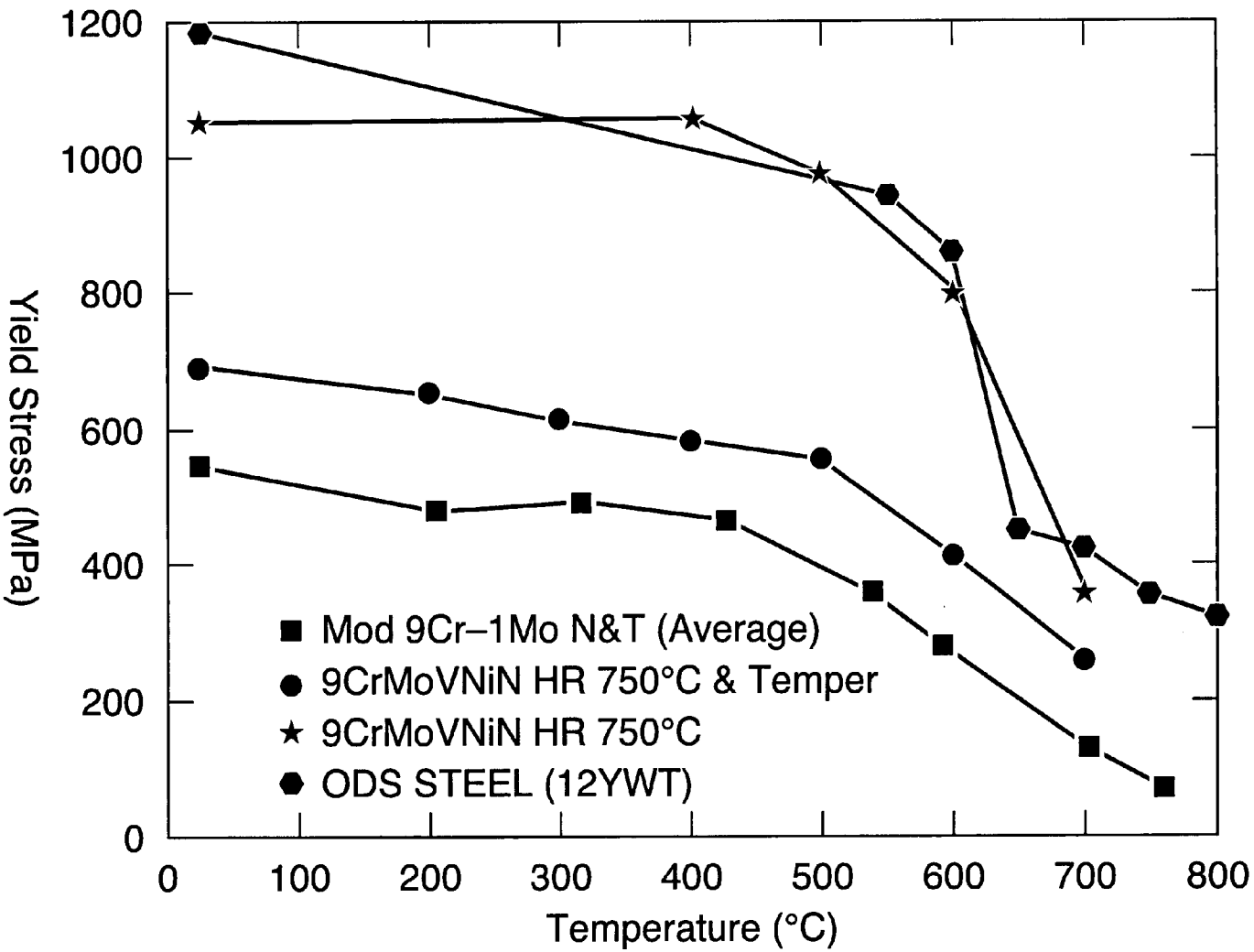
FIG. 14 is a graph showing yield stress data for 9Cr-1MoNiVN steel in hot-rolled/annealed and hot-rolled/annealed-and-tempered conditions. Also shown are data for normalized-and-tempered modified 9Cr-1Mo steel and ODS 12YWT steel.

To demonstrate the excellent strength properties of the new steels, the yield stress of 9Cr—MoNiVNbN was compared to an experimental ODS steel 12YWT produced by Kobe Steel that was shown to have superior strength to commercial ODS steels (see FIG. 14). Hot-rolled/annealed 9Cr—MoNiVNbN had yield stress values comparable to the 12YWT up to 700° C., the highest temperature at which 9Cr—MoNiVNbN was tested.

Figure 15:
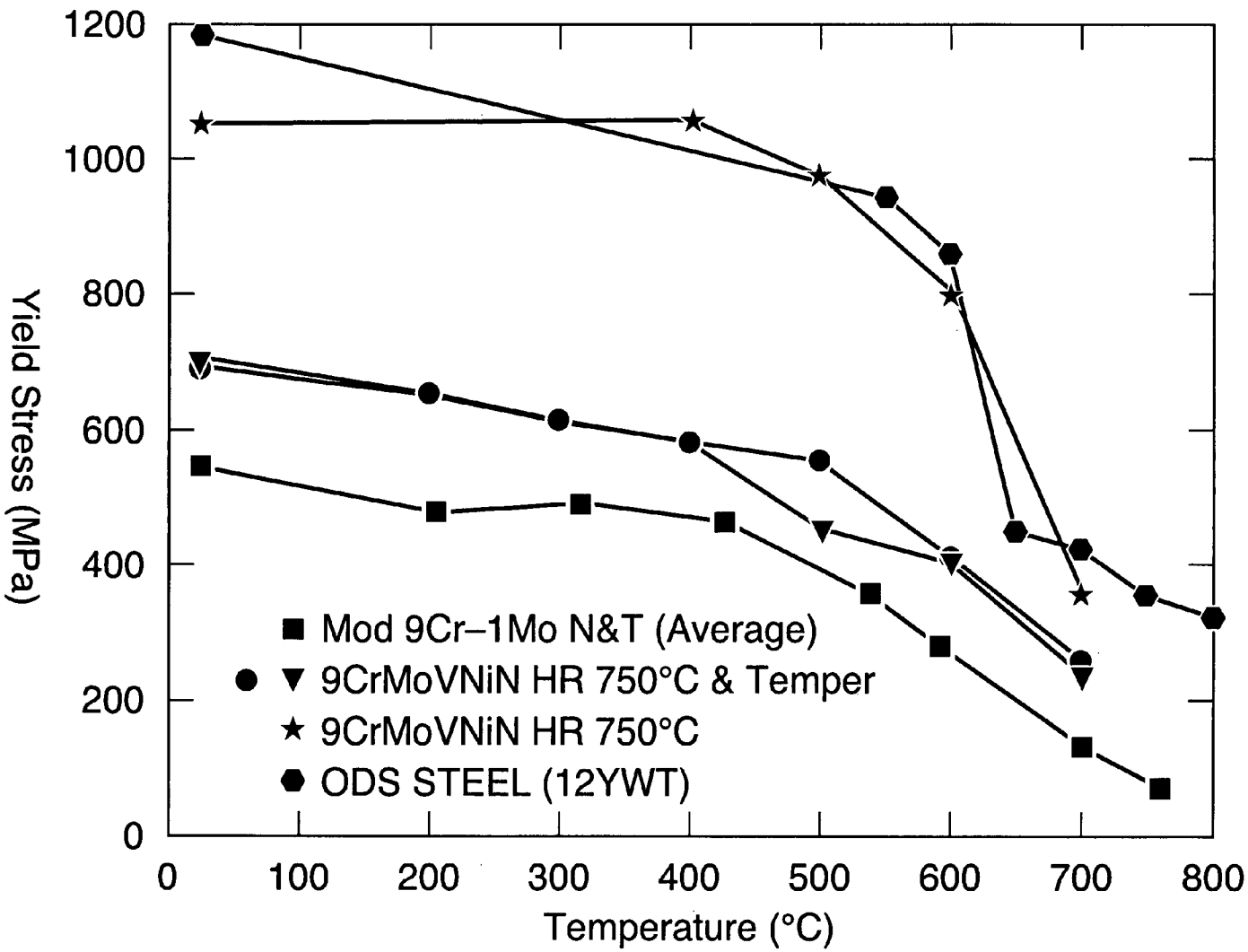
FIG. 15 is a graph showing yield stress of 9Cr-1MoNiVNbN steel in hot-rolled/annealed and hot-rolled/annealed-and-tempered conditions and 9Cr-1MoNiVNbN4 in hot-rolled/annealed-and-tempered condition showing the reproducibility of the data. Also shown are data for normalized-and-tempered modified 9Cr-1Mo steel and ODS 12YWT steel.
Figure 16A:
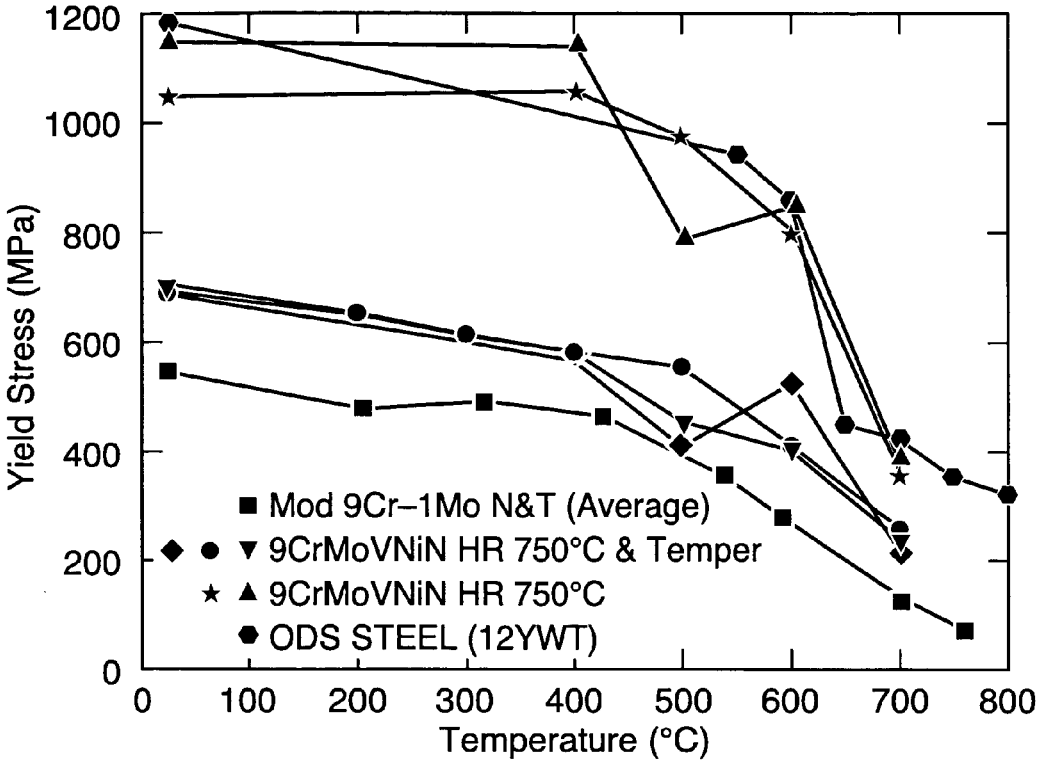
FIG. 16*a* is a graph showing yield stress of 9Cr-1MoNiVNbN steel and 9Cr-1MoNiVNbN2 steel in hot-rolled/annealed condition and 9Cr-1MoNiVNbN, 9Cr-1MoNiVNbN2, and 9Cr-1MoNiVNbN4 steels in the hot-rolled/annealed-and-tempered condition showing the reproducibility of the data. Also shown are data for normalized-and-tempered modified 9Cr-1Mo steel and ODS 12YWT steel.
Figure 16B:
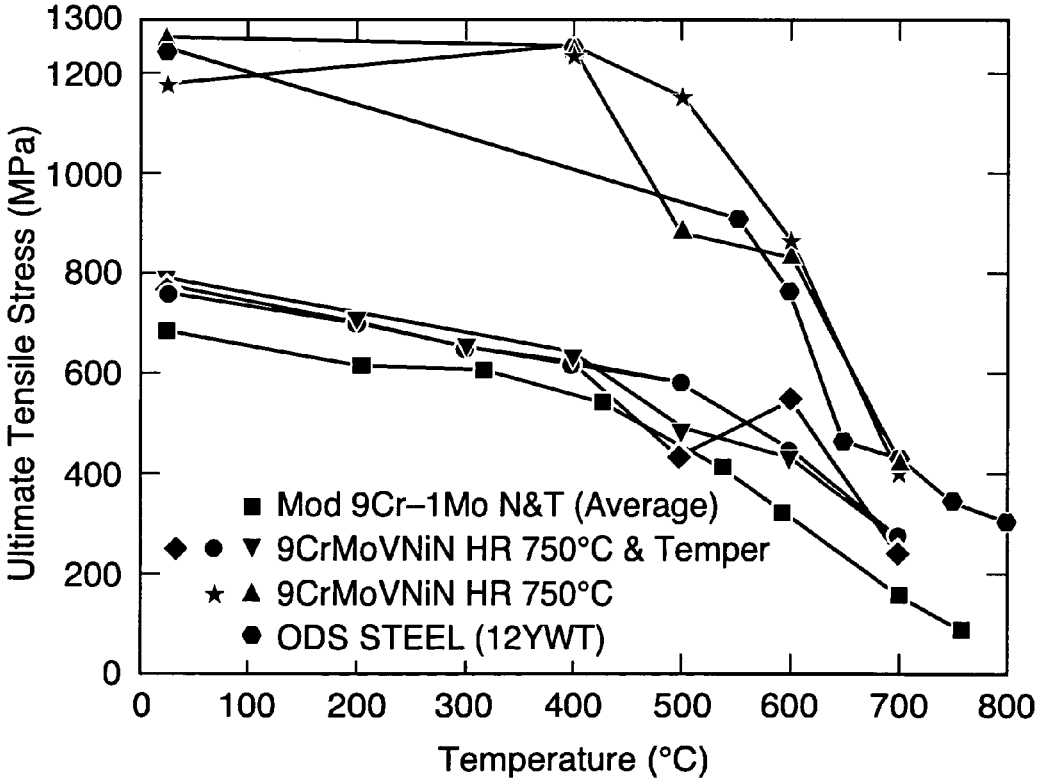
FIG. 16*b* is a graph showing ultimate tensile strength of 9Cr-1MoNiVNbN steel and 9Cr-1MoNiVNbN2 steel in hot-rolled/annealed condition and 9Cr-1MoNiVNbN, 9Cr-1MoNiVNbN2, and 9Cr-1MoNiVNbN4 steels in the hot-rolled/annealed-and-tempered condition showing the reproducibility of the data. Also shown are data for normalized-and-tempered modified 9Cr-1Mo steel and ODS 12YWT steel.

Steel 9Cr—MoNiVNbN4 was tested only in the hot-rolled/annealed-and-tempered condition, and the yield stress data were in excellent agreement with those obtained for 9Cr—MoNiVNbN steel (see FIG. 15). 9Cr—MoNiVNbN2 was tested in the hot-rolled/annealed condition with and without a temper, and the results for the two conditions agreed, in both cases, with the data from the other two steels. This was true for both yield stress and ultimate tensile strength (see FIGS. 16*a*, 16*b*), again a demonstration of the excellent reproducibility of the data.

Figure 17:
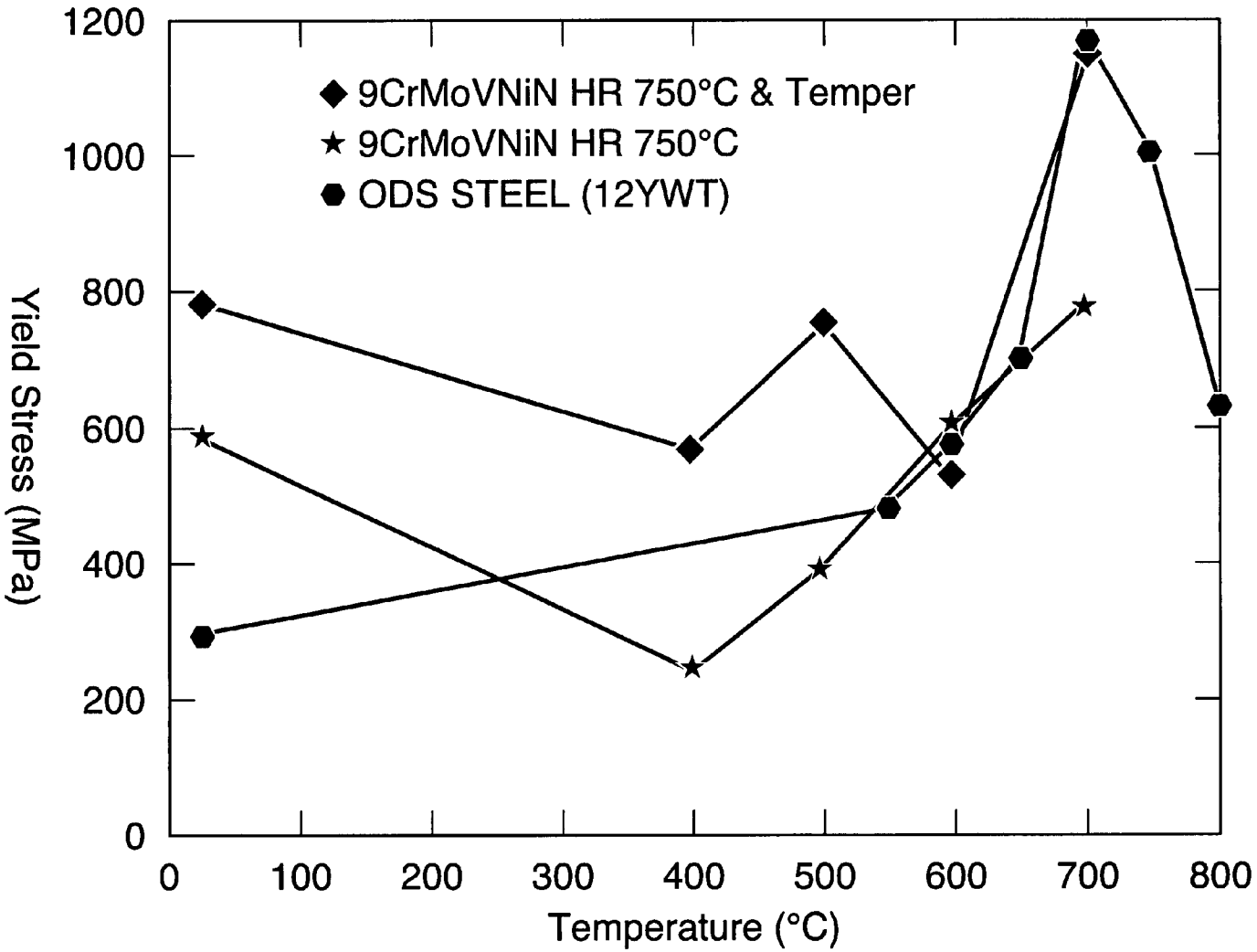
FIG. 17 is a graph showing total elongation of 9Cr-1MoNiVNbN steel in hot-rolled/annealed and hot-rolled/annealed-and-tempered conditions compared to ODS 12YWT steel.

Total elongation data are shown in FIG. 17 for 9Cr-1MoNiVNbN steel in the hot-rolled/annealed condition and the hot-rolled/annealed-and-tempered conditions. Data for the other two heats are comparable to these. Also shown are data for the ODS steel 12YWT, and it can be seen that comparable ductility results are obtained for the steels with comparable strengths.

Charpy impact toughness of 9Cr—MoNiVNbN and 9Cr—MoNiVNbN2 were determined on ⅓-size Charpy specimens and compared with commercial modified 9Cr-1Mo and Sandvik HT9 (12Cr-1MoVW) steels. See Table II. 9Cr—MoNiVNbN, 9Cr—MoNiVNbN2, and modified 9Cr-1Mo steels were tested with and without a temper for 1 h at 750° C., and the HT9 was tested after the 750° C. temper. A standard temper was also used for modified 9Cr-1Mo (1 h at 760° C.) and HT9 (2.5 h at 780° C.); this standard temper is the typical temper used for these steels to obtain adequate ductility and toughness for certain applications.

Tempering is carried out after the final cooling to ambient temperature (after the TMT) and at temperatures below the $A_{e1}$ temperature (critical equilibrium temperature below which the body-centered cubic ferrite or body-centered tetragonal martensite structures transform to the face-centered cubic austenite structure). Tempering can be carried out for times of up to 1 hour per inch of thickness. Tempering improves ductility and toughness of the steels of the present invention.

TABLE II

| | Untempered | | Tempered 1 h at 750° C. | | Standard Temper[a] | |
|---|---|---|---|---|---|---|
| Steel | DBTT (° C.) | USE (J) | DBTT (° C.) | USE (J) | DBTT (° C.) | USE (J) |
| 9Cr—MoNiVNbN | 47 | 3.6 | −26 | 14.5 | | |
| 9Cr—MoNiVNbN2 | 53 | 4.2 | −73 | 16.1 | | |
| Mod 9Cr—1Mo[b] | 39 | 5.7 | −22 | 8.7 | −57 | 8.8 |
| Sandvik HT9[b] | | | −36 | 6.5 | −46 | 6.0 |

[a]Modified 9Cr—1Mo: 1 h at 760° C.; Sandvik HT9: 2.5 h at 780° C.
[b]Normalized: 1 h at 1050° C.; rapid gas cool In the untempered condition, the ductile-brittle transition temperature (DBTT) and upper-shelf energy (USE) values obtained for the new steels were comparable to those for modified 9Cr-1Mo steel in the untempered condition. When tempered at 750° C., the DBTT values for 9Cr—MoNiVNbN and 9Cr—MoNiVNbN2 were as good as or better than for the two conventional steels. The DBTT values of 9Cr—MoNiVNbN2 were as good as those for the conventional steels given the standard temper. The USE values of the new 9Cr—MoNiVNbN and 9Cr—MoNiVNbN2 steels after the 750° C. temper were considerably better than for the two conventional steels after either temper.

EXAMPLE II

Improved Properties of Commercial Steels by New TMT Process

Because of the lack of availability of facilities to produce high-nitrogen steels of geometries that could be easily processed with the new TMT at available facilities, 25.4-mm (1-in.) plates of nitrogen-containing commercial steels used for elevated-temperature applications were obtained, and the new TMT was applied to those steels.

Table III lists nominal compositions of nitrogen-containing commercial steels that were obtained as 1-inch plates that are convenient geometries for applying the new TMT process.

TABLE III

| Steel | C | Si | Mn | Cr | Mo | W | V | Nb | B | N | Other |
|---|---|---|---|---|---|---|---|---|---|---|---|
| Mod 9Cr—1Mo (Grade 91) | 0.10 | 0.4 | 0.40 | 9.0 | 1.0 | | 0.2 | 0.08 | | 0.05 | |
| E911 | 0.11 | 0.4 | 0.40 | 9.0 | 1.0 | 1.0 | 0.20 | 0.08 | | 0.07 | |
| NF616 (Grade 92) | 0.07 | 0.06 | 0.45 | 9.0 | 0.5 | 1.8 | 0.20 | 0.05 | 0.004 | 0.06 | |
| HCM12A (Grade 122) | 0.11 | 0.1 | 0.60 | 12.0 | 0.4 | 2.0 | 0.25 | 0.05 | 0.003 | 0.06 | 1.0Cu 0.3Ni |

To determine the TMT conditions, the equilibrium microstructures were calculated for different commercial-steeel compositions using the computational thermodynamic program JMatPro. An example of such a calculation is shown in FIGS. 1*a*, 1*b* for modified 9Cr-1Mo steel with the composition shown in Table III.

Plates of ≈102×152×25.4 mm (4×6×1 in.) were subjected to TMT in accordance with steps 1-4 of the five-step process described hereinabove. The steels were hot rolled 20-60% in the range 600-1000° C. with intermediate reheats between rolling passes to bring the plates back to the hot-rolling temperature. Selected steels were subsequently tempered in accordance with step 5.

Because of the larger size of the commercial plates, it was not necessary to encapsulate the plates as required by the use of the small ingots of EXAMPLE I.

Microstructure

The new thermomechanical treatment with different hot-rolling and annealing conditions was applied to several 1-inch-thick plates of modified 9Cr-1Mo steel. Microstructures containing a high number density of nano-sized particles were formed as shown and described in FIGS. 18-20. Comparison is drawn between these microstructures and the microstructure shown in FIG. 3*b* of modified 9Cr-1Mo steel after the conventional normalizing-and-tempering heat treatment.

The increase in the number of MX particles obtained by applying the new TMT is demonstrated in Table IV where the size and number density of MX particles achieved by the different TMTs is compared with the size and number density of MX particles present after a conventional normalizing-and-tempering heat treatment. In Table IV, only statistics on the MX precipitates are presented, since these small precipitates at a high number density are expected to provide the elevated-temperature strength to the steel.

TABLE IV

| Experiment | TMT | MX Precipitates Average Size (nm) | MX Precipitates Number Density ($m^{-3}$) |
|---|---|---|---|
| Control | Normalized & Tempered | 32 | $7.9 \times 10^{18}$ |
| TMT 1 | Hot Rolled 60%/Annealed | 7.2 | $8.9 \times 10^{21}$ |
| TMT 2 | Hot Rolled 20%/Annealed | 7.3 | $2.1 \times 10^{21}$ |
| TMT 3 | Hot Rolled 60%/Annealed | 8.0 | $1.9 \times 10^{21}$ |

All of the processing procedures of modified 9Cr-1Mo steel in Table IV produced a high number density of small MX particles. Particle size was about 25% as large as the size in the normalized-and-tempered condition, and the number density of particles increased by up to three orders of magnitude, depending on the processing procedure. Precipitate particle size will depend on the hot-rolling temperature, the number of rolling passes, intermediate reheats between passes, and on the time and temperature for the annealing after hot rolling, all variables that can be controlled to produce the desired microstructure. Matrix microstructure can be varied by these same processing variables. Note that the matrix microstructure will depend partly on whether the TMT is carried out above or below the $Ar_3$ temperature—the temperature at which austenite transforms to ferrite during cooling.

Figure 18A:
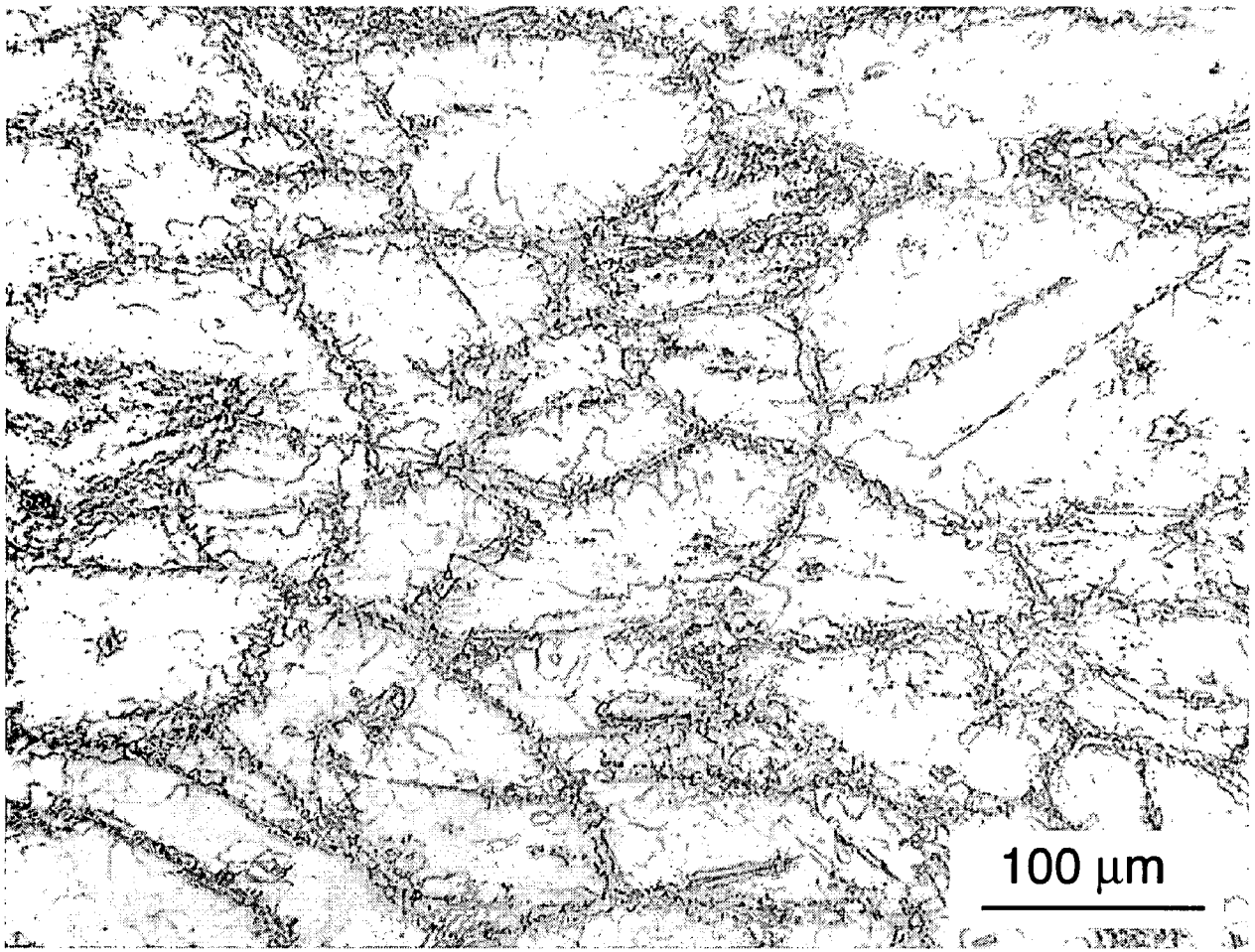
FIG. 18*a* is an optical photomicrograph showing the microstructure of modified 9Cr-1Mo steel after TMT1.
Figure 18C:
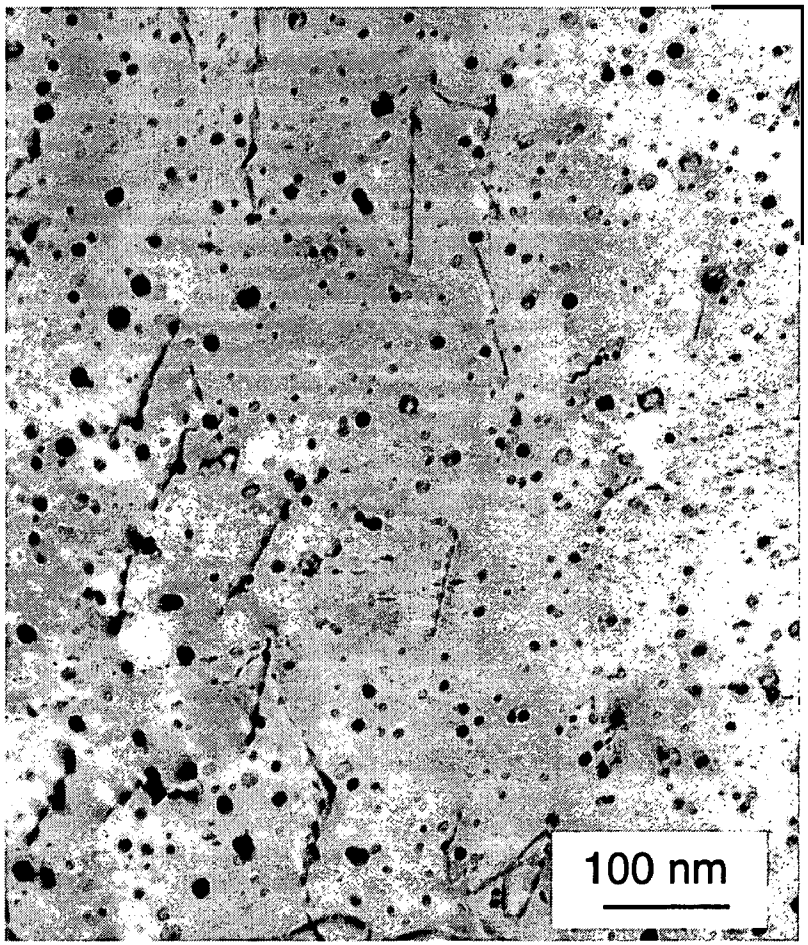
FIG. 18*c* is a portion of the TEM photomicrograph shown in FIG. 18*b* at a greater magnification.
Figure 18B:
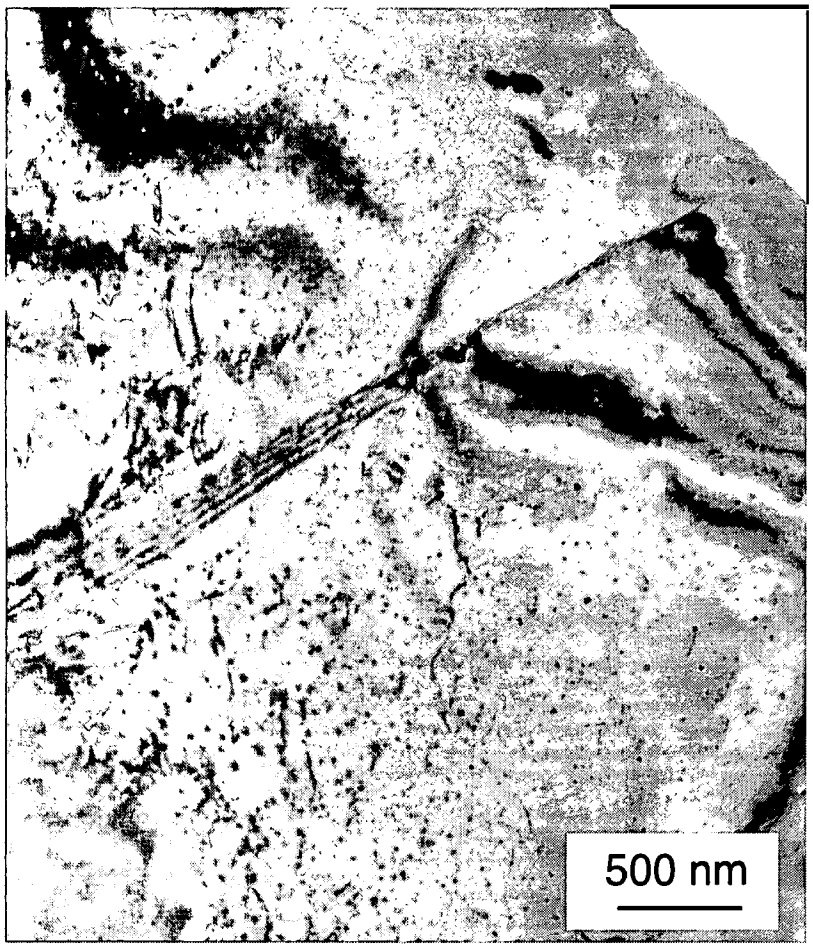
FIG. 18*b* is a TEM photomicrograph showing the microstructure of modified 9Cr-1Mo steel after TMT1.
Figure 19A:
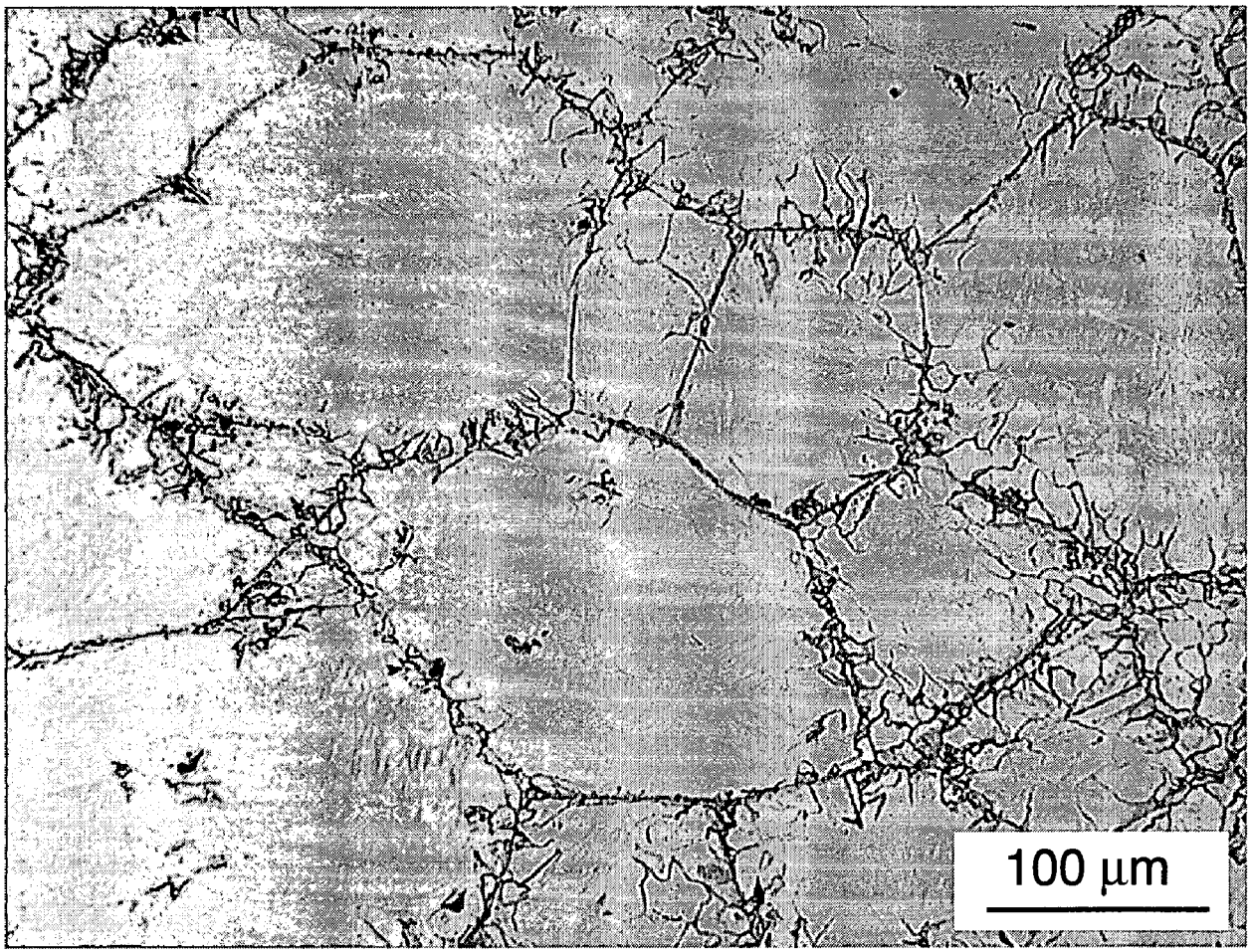
FIG. 19*a* is an optical photomicrograph showing the microstructure of modified 9Cr-1Mo steel after TMT2.
Figure 19C:
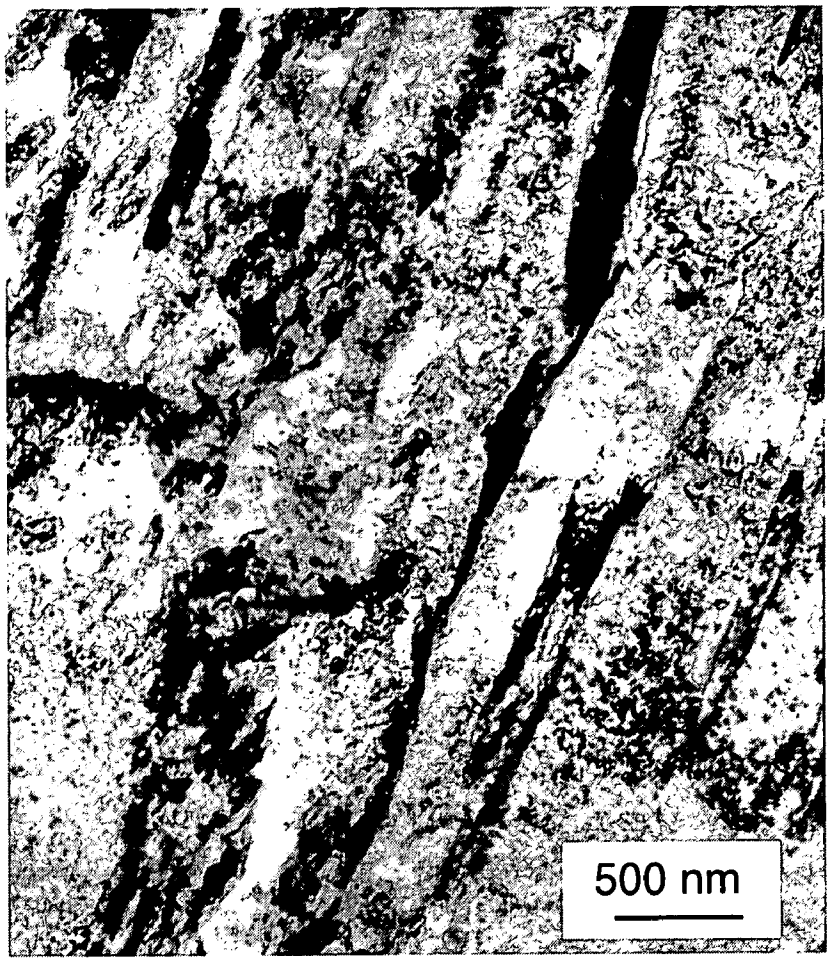
FIG. 19*c* is a TEM photomicrograph showing the martensitic microstructure of modified 9Cr-1Mo steel after TMT2.
Figure 19B:
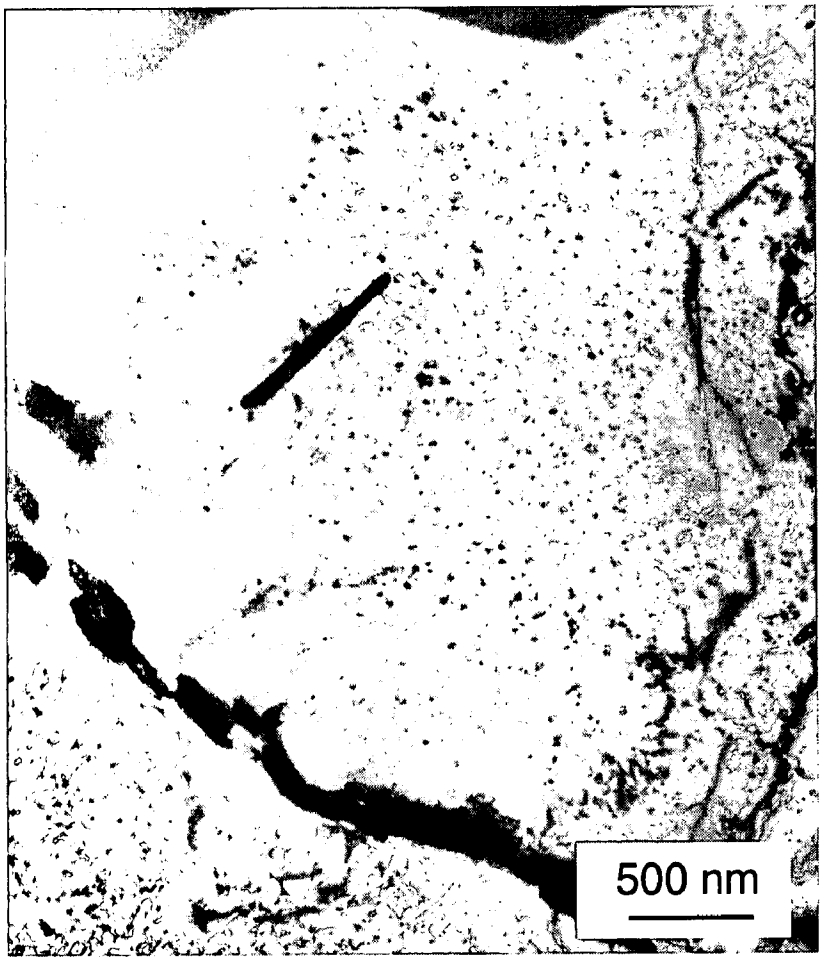
FIG. 19*b* is a TEM photomicrograph showing the ferritic microstructure of modified 9Cr-1Mo steel after TMT2.

The matrix microstructure of TMT1 (processed by multiple passes below $Ar_3$) was primarily polygonal ferrite formed during re-annealing between passes and annealing after hot rolling. Nucleation of the polygonal ferrite began at austenite grain boundaries, giving rise to an optical microstructure with small ferrite grains at prior-austenite grain boundaries (FIG. 18). Some of the grains formed at the boundaries grew into the large grains that subsequently filled prior-austenite grain interiors. Small amounts of martensite were observed inside some grains, because all of the austenite of the grain had not transformed to ferrite during annealing. Martensite formed during cooling to ambient temperature. Some fairly large $M_{23}C_6$ particles formed on the prior-austenite and ferrite grain boundaries.

A somewhat different microstructure was obtained for TMT2 because it received only one hot-rolling pass compared to eight for TMT1. Small ferrite grains again outline the prior-austenite grains, but in this case, the grain interiors are martensite. Both the ferrite and martensite contain a high density of fine precipitates (FIG. 19), and $M_{23}C_6$ particles are again found on the grain boundaries, similar to those found in TMT1.

Figure 20A:
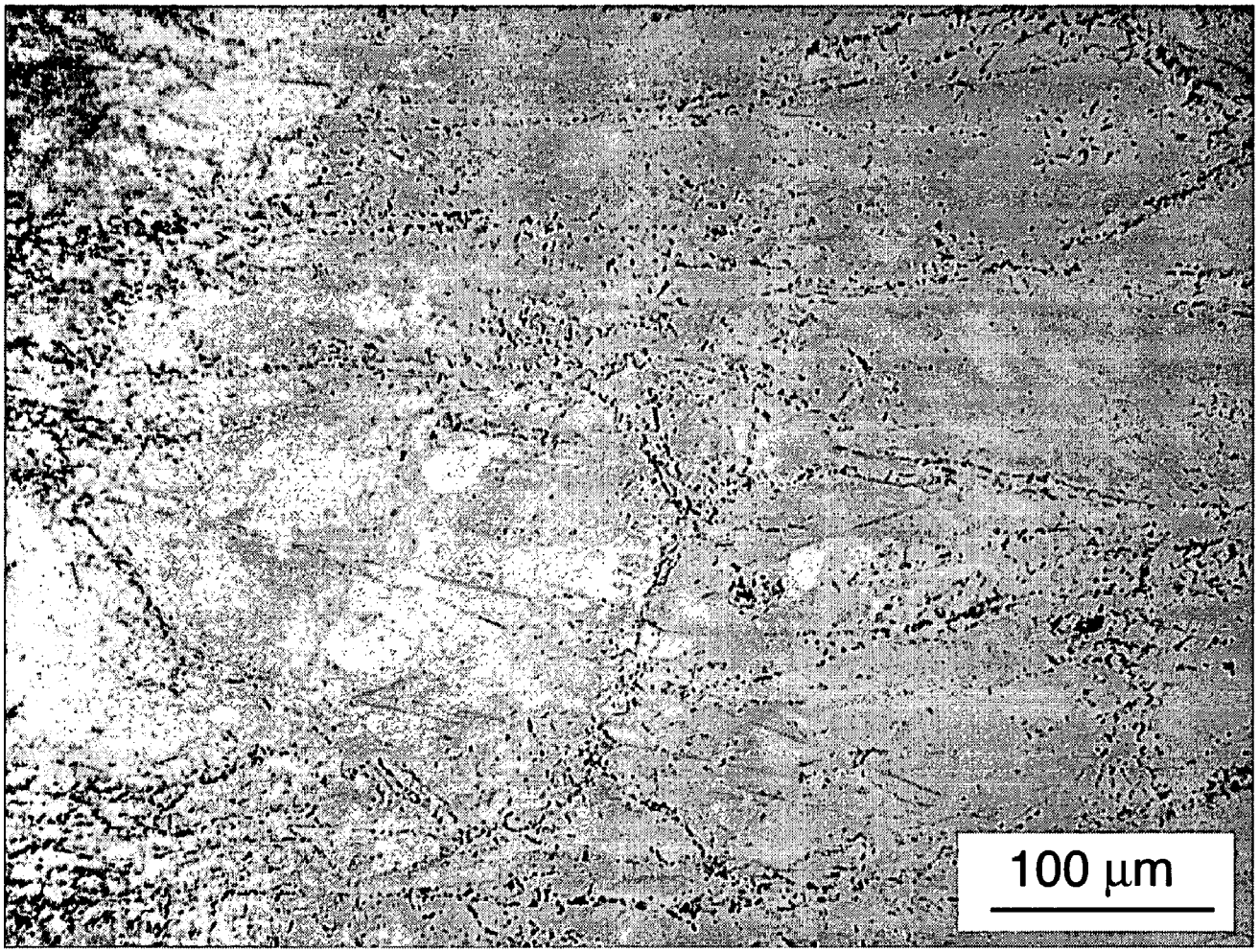
FIG. 20*a* is an optical photomicrograph showing the microstructure of modified 9Cr-1Mo steel after TMT3.
Figure 20C:
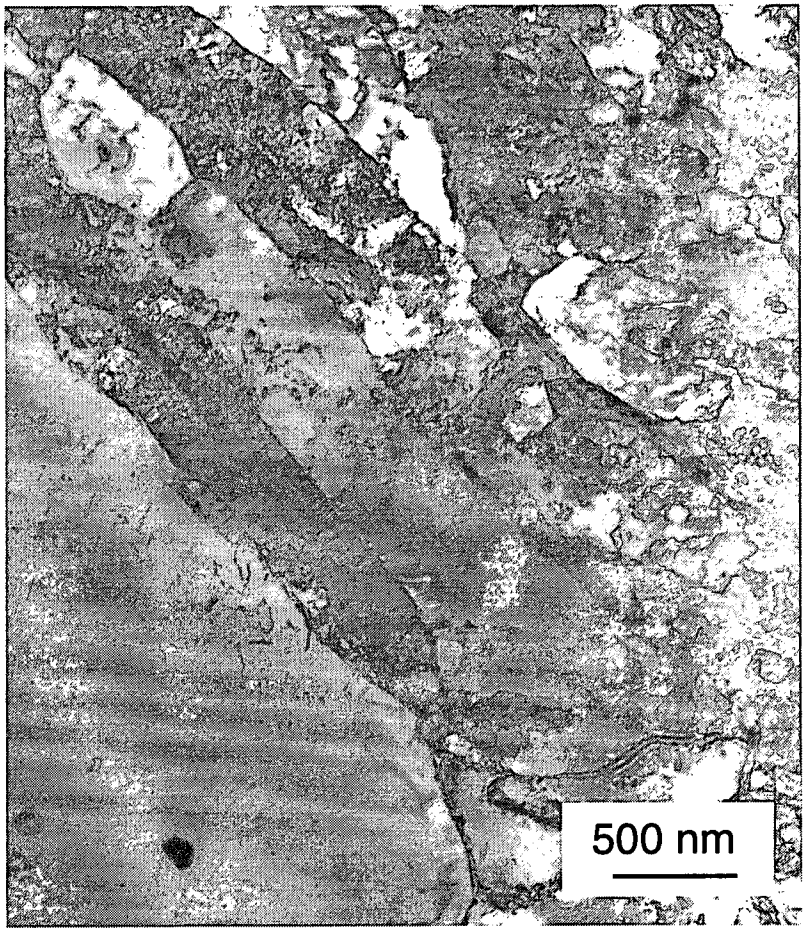
FIG. 20*c* is a TEM photomicrograph showing the martensitic microstructure of modified 9Cr-1Mo steel after TMT3.
Figure 20B:
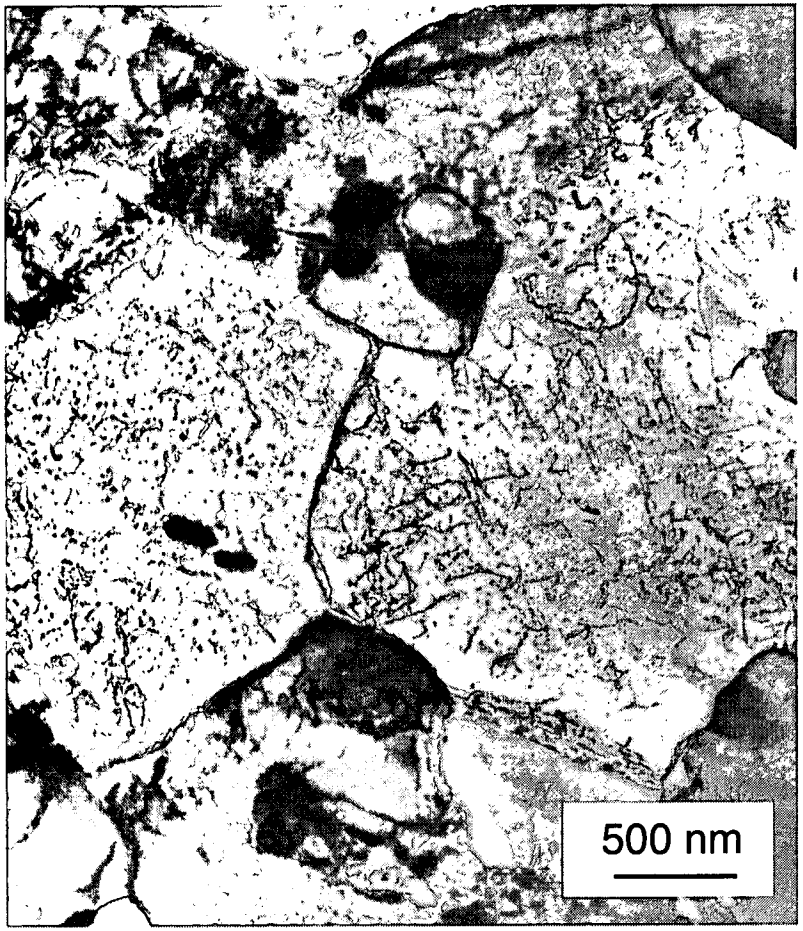
FIG. 20*b* is a TEM photomicrograph showing the ferritic microstructure of modified 9Cr-1 Mo steel after TMT3.

Finally, TMT3 (six passes below $Ar_3$) produced a microstructure similar to TMT1 and TMT2, but with somewhat more martensite than TMT1 and less martensite than TMT2 (FIG. 20).

Figure 21A:
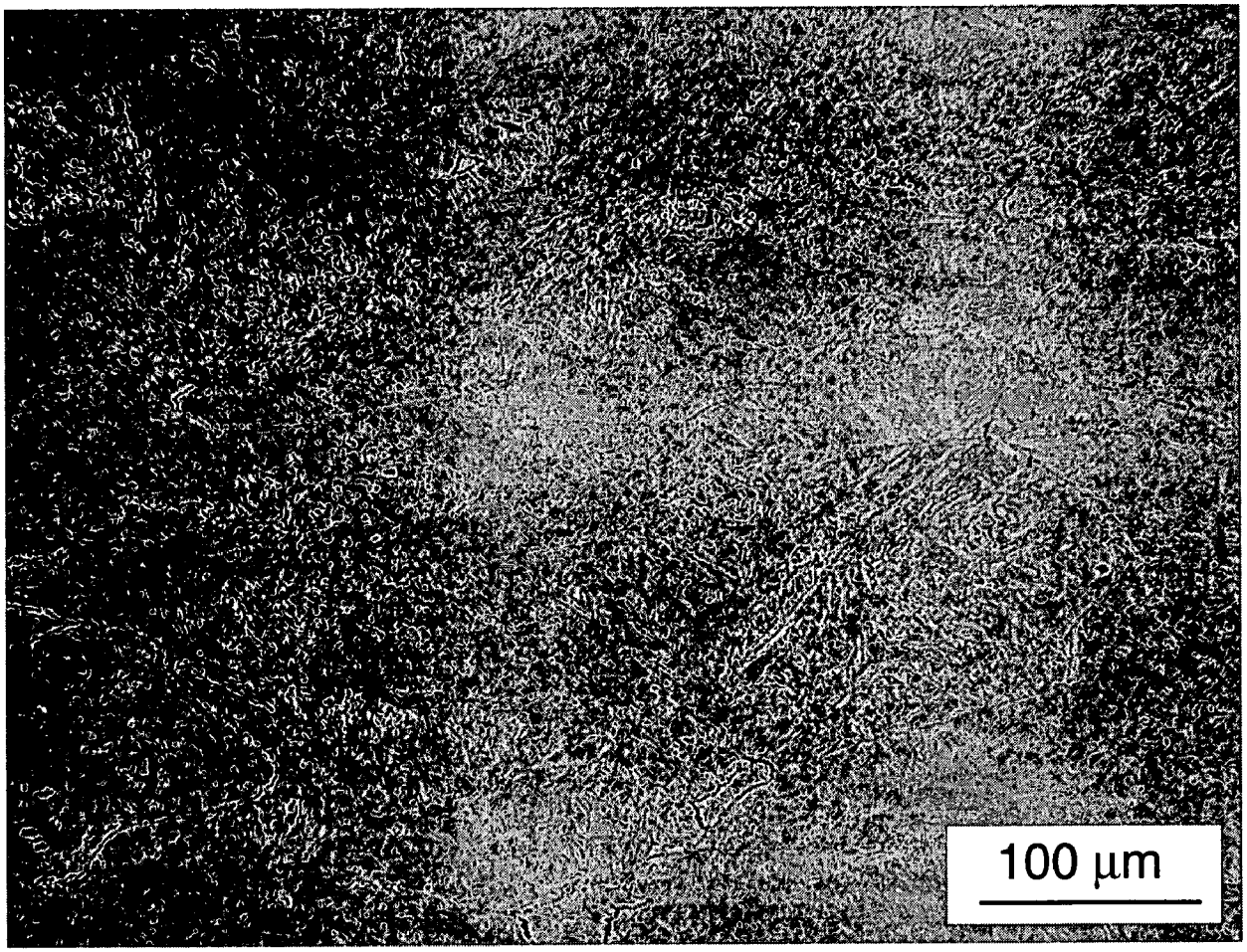
FIG. 21*a* is an optical photomicrograph showing the microstructure of modified HCM12A steel after TMT4.
Figure 21C:
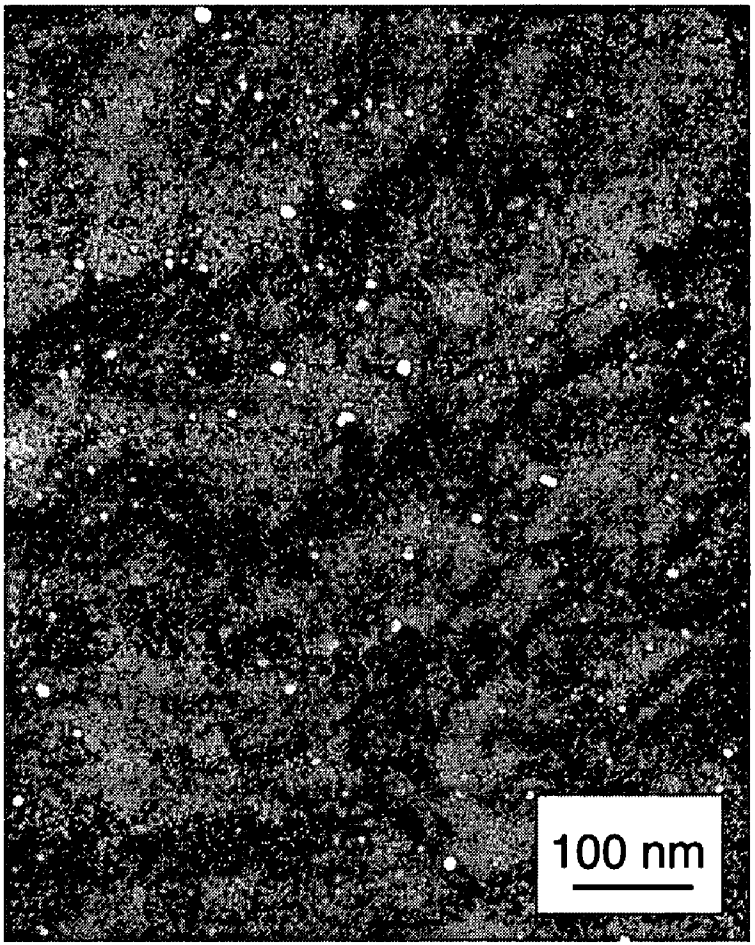
FIG. 21*c* is a dark field TEM photomicrograph showing the microstructure of modified HCM12A steel after TMT4.
Figure 21B:
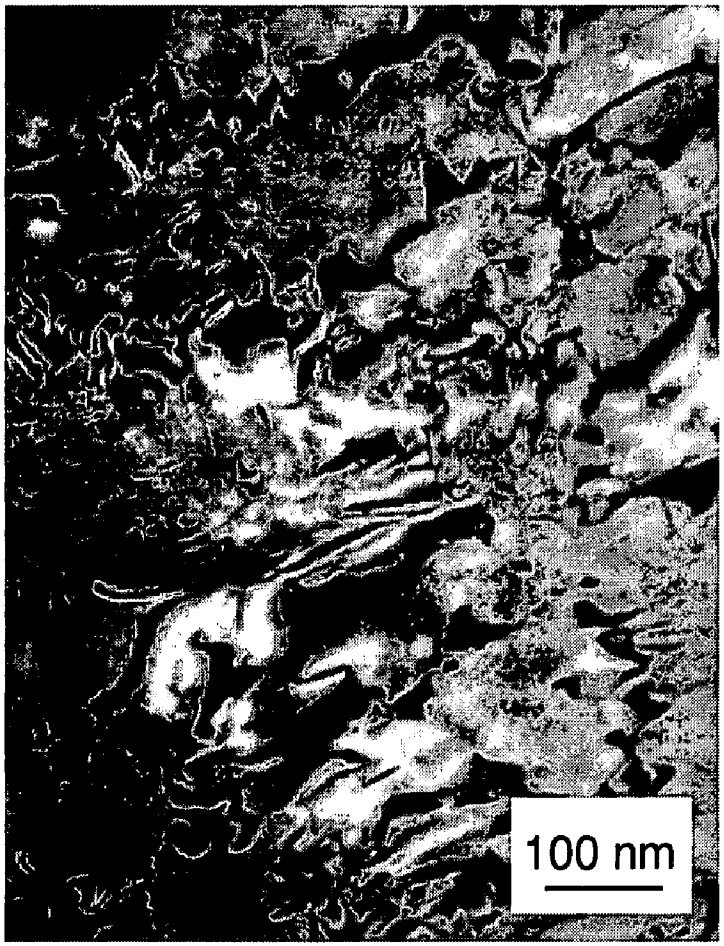
FIG. 21*b* is a bright field TEM photomicrograph showing the microstructure of modified HCM12A steel after TMT4.

When commercial HCM12A steel was also subjected to a TMT process (TMT4) of hot rolling 50% (3 passes) at 800° C. (no anneal), no fine precipitates could be detected by TEM. However, when the steel was tempered at 750° C. for 1 h, fine precipitates were observed (FIG. 21), indicating that TMT4 (hot rolling) produced very fine precipitates that then grew during tempering. Comparison is drawn between the microstructure of HCM12A after the TMT, shown in FIG. 21, with the microstructure of HCM12A after normalizing-and-tempering, shown in FIG. 3*d*, to appreciate the effectiveness of the TMT in accordance with the present invention to produce a high number density nano-scale precipitates.

Precipitate size and number density in HCM12A after TMT4 were estimated at 4.2 nm and $2.4\times10^{21}$ $m^{-3}$, respectively, which is similar to the observation on modified 9Cr-1Mo steel after the TMT treatments. The size and number density of the MX particles in the normalized-and-tempered HCM12A were not measured, but based on visual observation, they are similar to those of the normalized-and-tempered modified 9Cr-1Mo steel (30 mm and $1\text{-}3\times10^{19}$ $m^{-3}$, respectively).

These results indicate that with the TMT treatment on nitrogen-containing commercial steels followed by the temper, the precipitate particles produced are quite small.

A second HCM12A plate (TMT5) was hot rolled 50% (3 passes) at 750° C. Again, no precipitates were detected after the TMT, and in this case, no precipitates were detected even after tempering at 750° C. for 1 h, even though, as described below, the strength was increased, indicating that very fine precipitates were produced in the TMT process.

The nitrogen-containing commercial steels NF616 (Grade 92) and E911 with the compositions given in Table III were also given the TMT processing with a similar production of a high density of MX precipitates.

Mechanical Properties

Figure 22A:
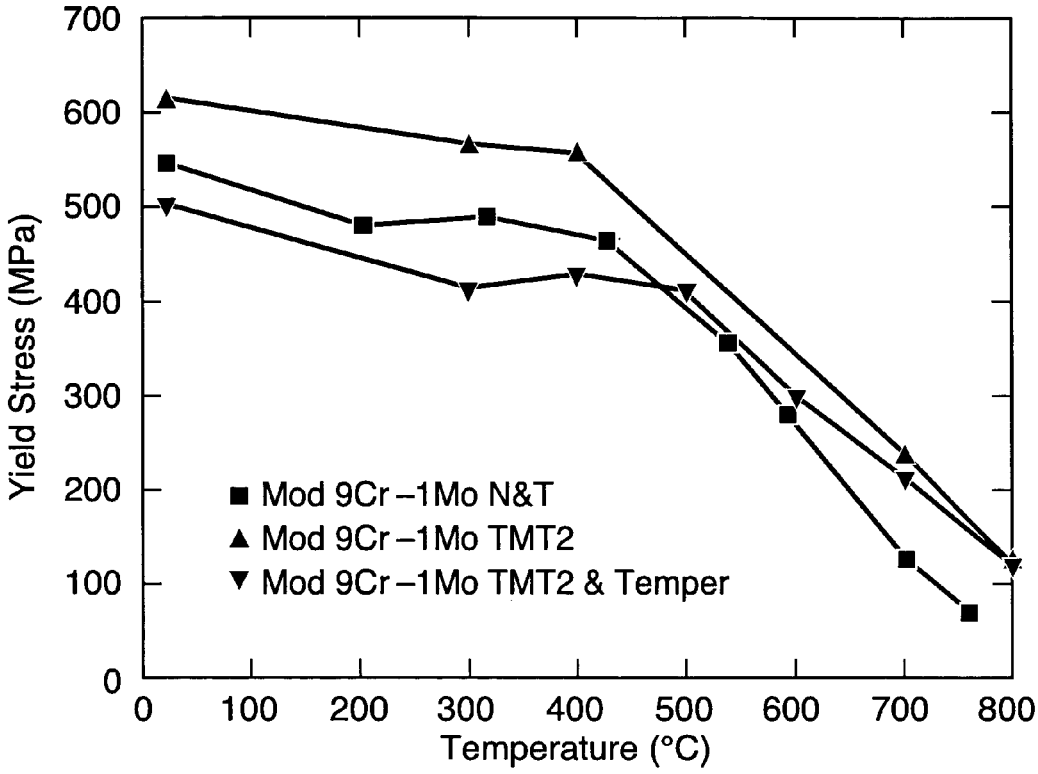
FIG. 22*a* is a graph showing yield stress of modified 9Cr-1Mo steel as normalized and tempered, after TMT2, and after TMT2 and temper.
Figure 22B:
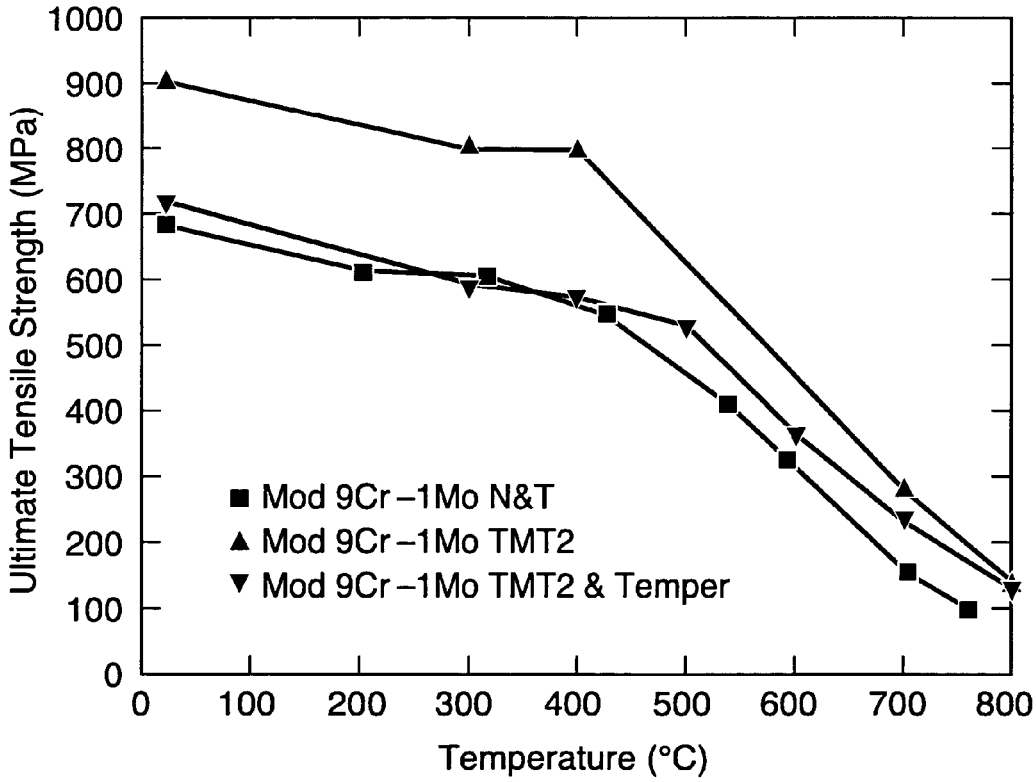
FIG. 22*b* is a graph showing ultimate tensile strength of modified 9Cr-1Mo steel as normalized and tempered, after TMT2, and after TMT2 and temper.

Tensile tests were conducted on modified 9Cr-1Mo steel after TMT2 and after TMT2 plus a 750° C. temper and compared to average values for modified 9Cr-1Mo steel in the normalized-and-tempered condition as shown in FIG. 22.

After TMT2 (no temper), the yield stress and ultimate tensile strength (FIG. 22) were considerably above those for the normalized-and-tempered modified 9Cr-1Mo steel from room temperature to 800° C., with the difference decreasing with increasing test temperature.

The total elongation of the TMT2 steel was less than that of the normalized-and-tempered steel (FIG. 23), but given the strength levels of the steel, the ductility is excellent.

Figure 23:
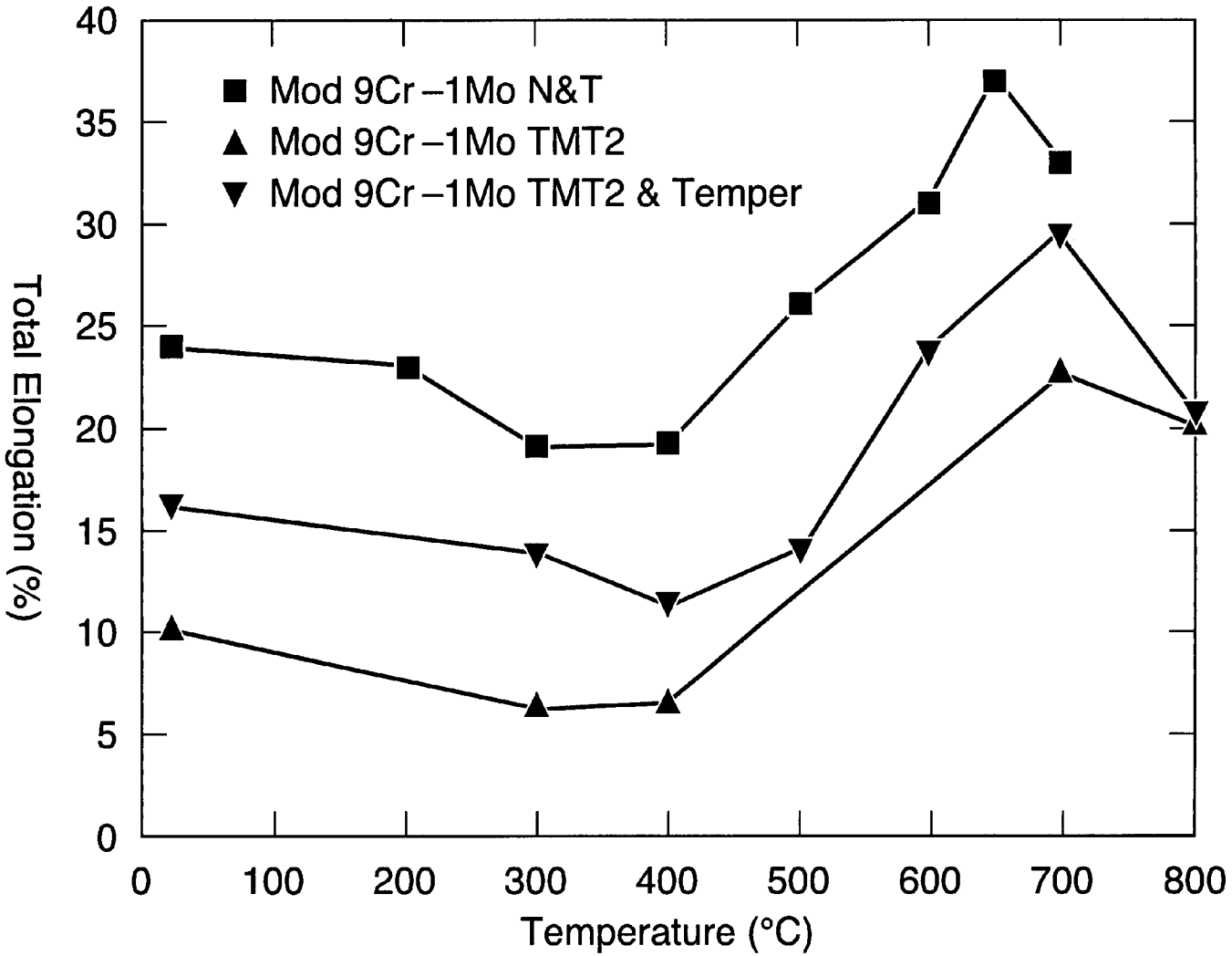
FIG. 23 is a graph showing total elongation of modified 9Cr-1Mo steel as normalized and tempered, after TMT2, and after TMT2 and temper.
Figure 24A:
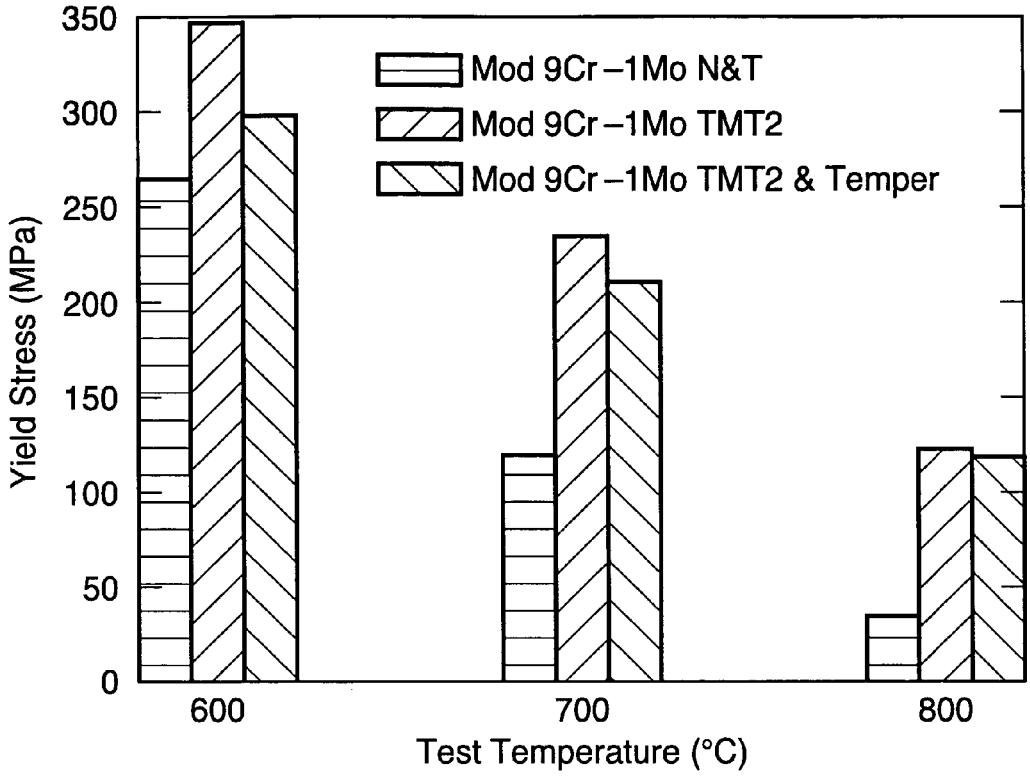
FIG. 24*a* is a graph showing elevated-temperature yield stress of modified 9Cr-1Mo steel as normalized and tempered, after TMT2, and after TMT2 and temper.
Figure 24B:
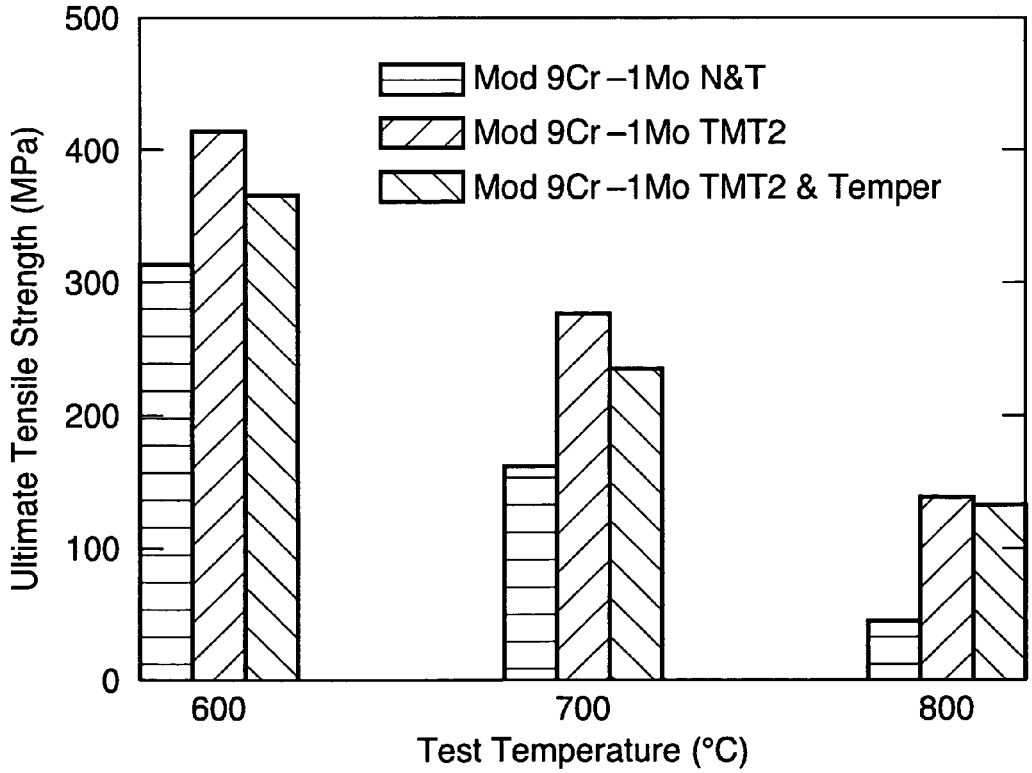
FIG. 24*b* is a graph showing elevated-temperature ultimate tensile strength of modified 9Cr-1Mo steel as normalized and tempered, after TMT2, and after TMT2 and temper.

When the TMT2 steel was tempered at 750° C., the strength decreased (FIG. 22) and the ductility increased (FIG. 23). At the lower test temperatures (<500° C.), the strength was below that of the normalized-and-tempered modified 9Cr-1Mo. However, above 500° C. the tempered TMT2 steel was stronger than modified 9Cr-1Mo, thus, again demonstrating the effectiveness of the high density of precipitates on elevated-temperature strength. A significant difference in strength between the normalized-and-tempered steel and the TMT2 steel, with and without the temper, was observed for the tests at 600, 700, and 800° C. for both the yield stress and ultimate tensile strength (FIG. 24). The difference increased with increasing temperature. The largest difference was observed for TMT2 without the temper, which had yield stress and ultimate tensile strength differences with the normalized-and-tempered steel at 600, 700, and 800° C. of 31% and 32%, 95% and 73%, and 251% and 198%, respectively.

Figure 25:
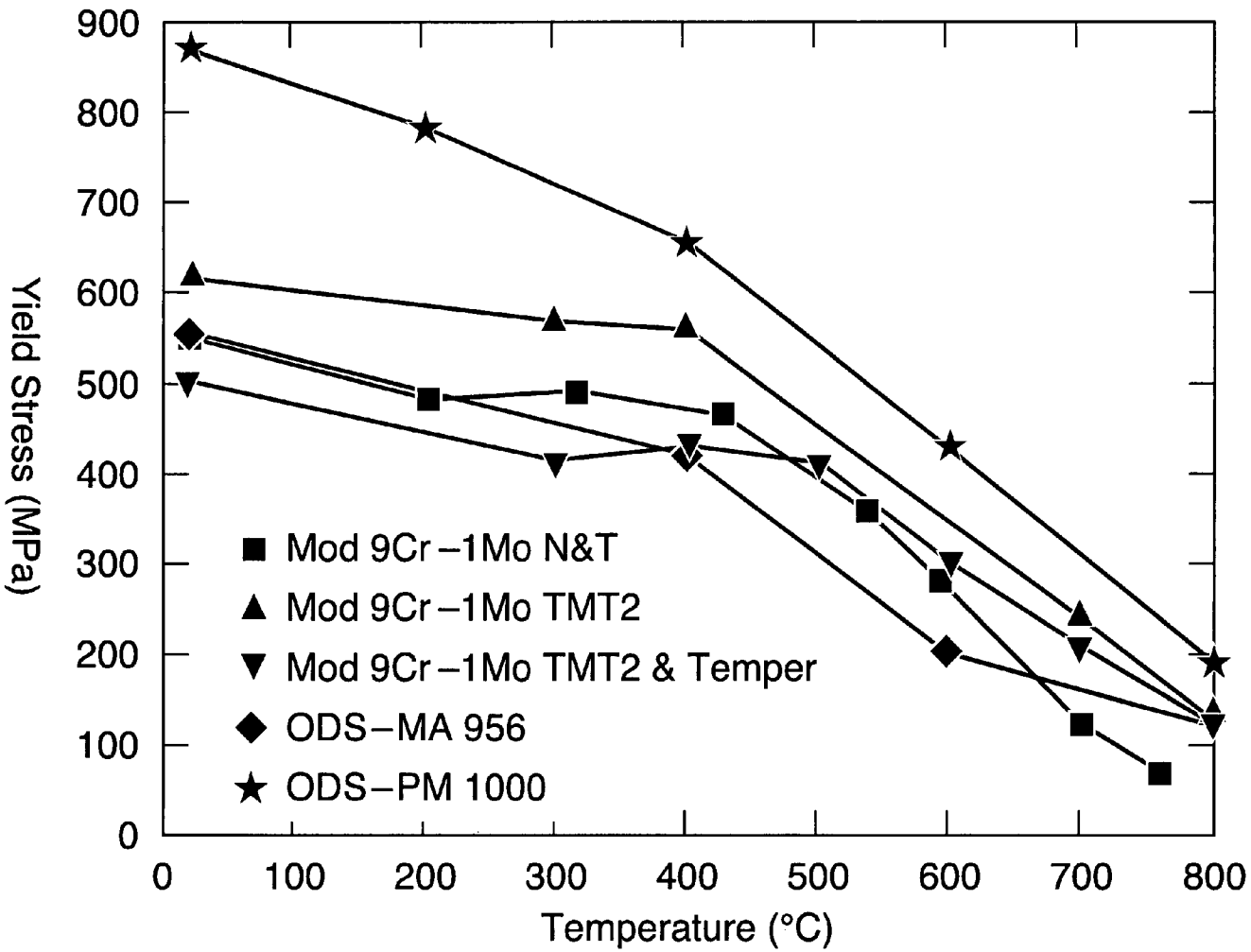
FIG. 25 is a graph showing a comparison of the yield stress of modified 9Cr-1Mo steel as normalized and tempered, after TMT2, and after TMT2 and temper with two commercial ODS steels: MA 956 and PM 2000.

As discussed hereinabove, ODS steels have excellent elevated-temperature strength, so the properties of TMT2 were compared to two commercial ODS products: MA 956 manufactured by Special Metals Corporation, Huntington, W. Va., and PM 2000 manufactured by Metallwerk Plansee Gmb/Leckbruck, Germany (FIG. 25). Data for the ODS steels are from vendor literature, and it is obvious that up to 800° C., modified 9Cr-1Mo with TMT2 (no temper) is as strong or stronger than MA 956 (listed by the vendor as nominally Fe-18.5-21.5Cr-3.75-4.75Al-0.30-0.70$Y_2O_3$-0.20-0.60Ti-0.30 Mn with Cu: 0.15 max, Ni: 0.50 max, C: 0.10 max, Co: 0.30 max, P: 0.02 max). The TMT2 with the temper is as strong or stronger at /400° C. The TMT2 steel is not as strong as the PM 2000 (listed by the vendor as nominally Fe-19Cr-5.5Al-0.5Ti-0.5$Y_2O_3$).

Figure 26A:
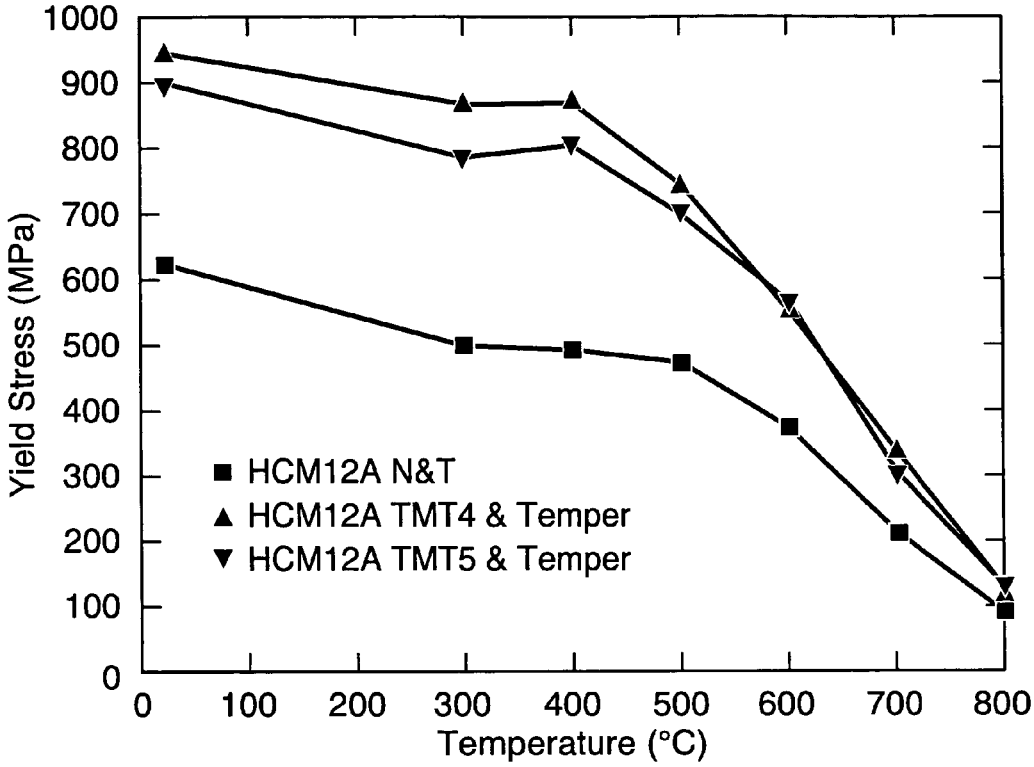
FIG. 26*a* is a graph showing yield stress of HCM12A steel as normalized and tempered, after TMT4 and temper, and after TMT5 and temper.
Figure 26B:
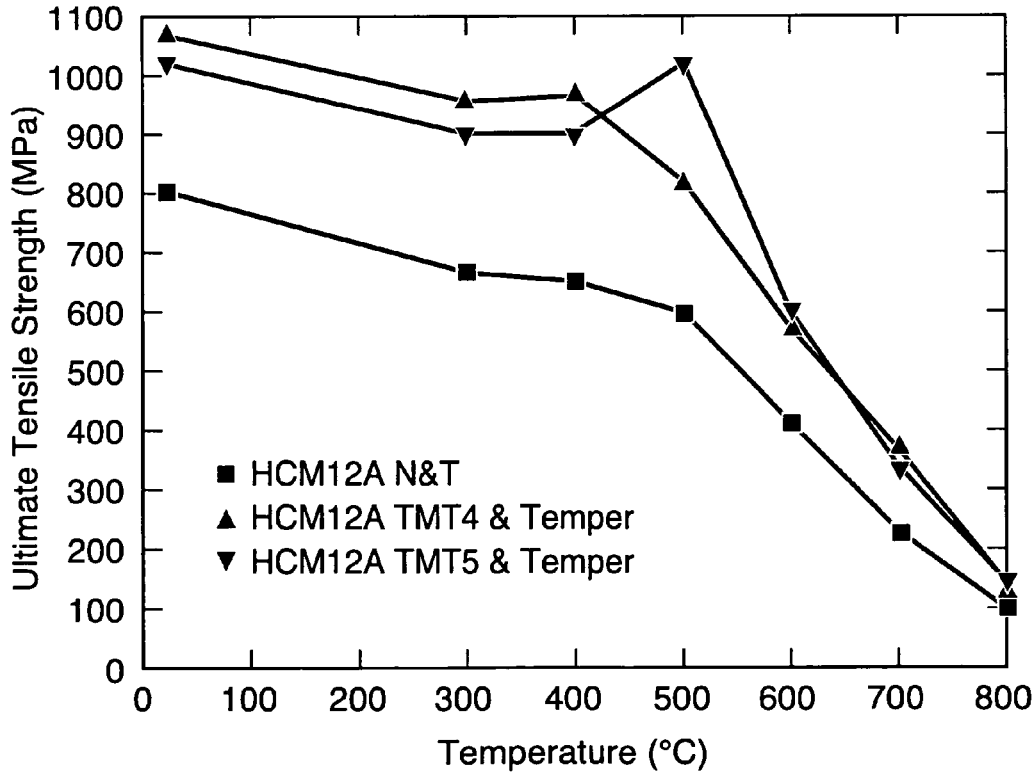
FIG. 26*b* is a graph showing ultimate tensile strength of HCM12A steel as normalized and tempered, after TMT4 and temper, and after TMT5 and temper.

HCM12A in the TMT4 (hot rolled with a single pass at 800° C.) with a 1 h temper at 750° C. and TMT5 (hot rolled with a single pass at 750° C.) with the 1 h temper at 750° C. showed strengthening at all temperatures relative to the normalized-and-tempered steel (FIG. 26).

Figure 27:
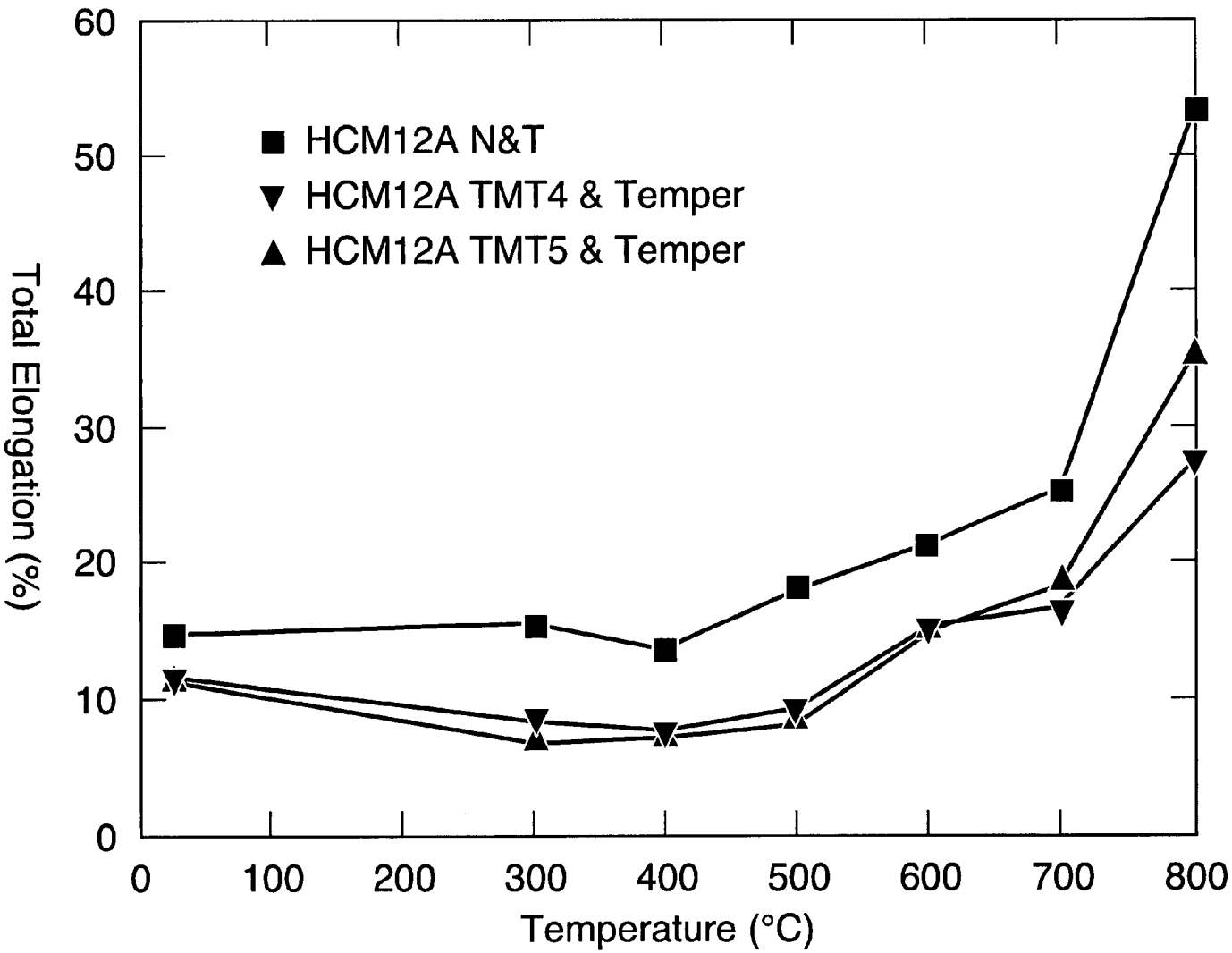
FIG. 27 is a graph showing total elongation of HCM12A steel as normalized and tempered, after TMT4 and temper, and after TMT5 and temper.

Total elongation (FIG. 27) was somewhat lower for the steels given the TMTs plus temper than for the normalized-and-tempered steel, although there was still adequate ductility.

Figure 28A:
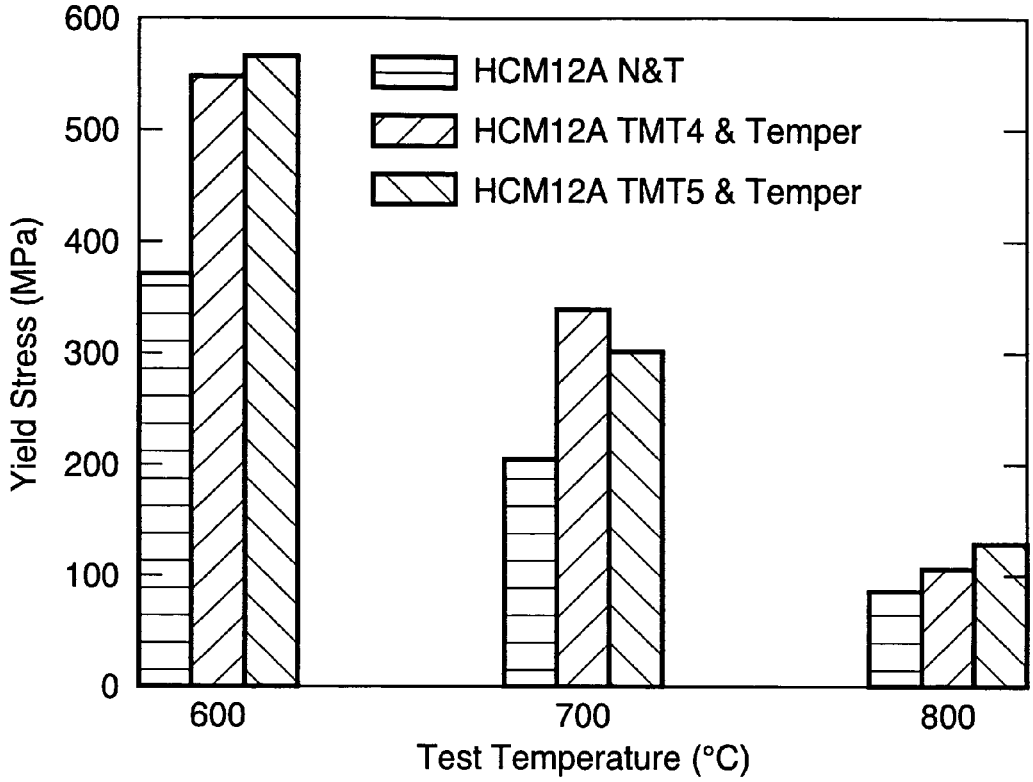
FIG. 28*a* is a graph showing elevated-temperature yield stress of modified HCM12A steel as normalized and tempered, after TMT4 and temper, and TMT5 and temper.
Figure 28B:
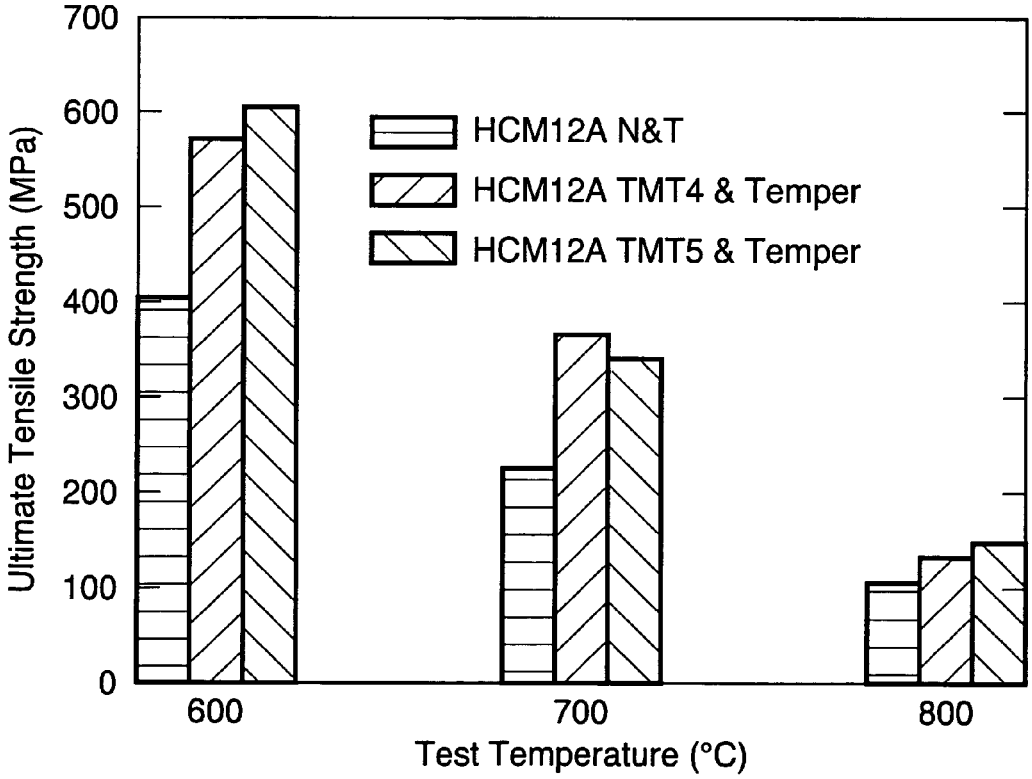
FIG. 28*b* is a graph showing elevated-temperature ultimate tensile strength of modified HCM12A steel as normalized and tempered, after TMT4 and temper, and TMT5 and temper.

Significant relative differences in strength at 600, 700, and 800° C. were observed between the normalized-and-tempered steel and TMT4 and TMT5 with the temper (FIG. 28). These differences are important because they will reflect the difference expected in creep strength over the temperature range the steel would be used (600-700° C.). The strengths of the tempered TMT4 and TMT5 were quite similar at these temperatures, resulting in relative strength differences of 40-60% at 600-700° C. and 20-50% at 800° C.

Figure 29:
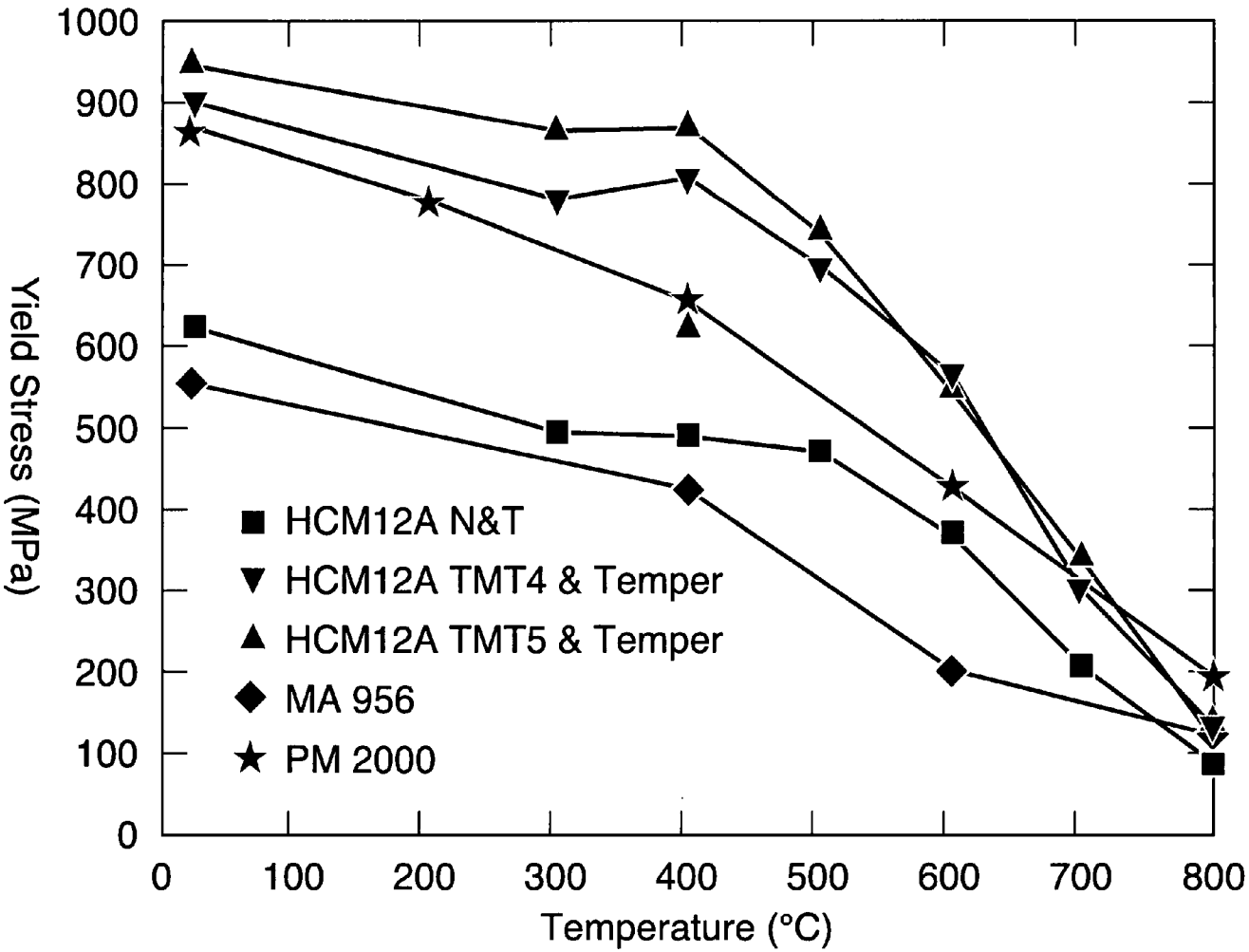
FIG. 29 is a graph showing a comparison of the yield stress of HCM12A steel as normalized and tempered, after TMT4 and temper, and after TMT5 and temper with two commercial ODS steels: MA 956 and PM 2000.

A comparison of the yield stress values of commercial ODS steels MA 956 and PM 2000 with those for HCM12A as normalized and tempered and after TMT4 and TMT5 with the temper (FIG. 29) indicates that the latter two steels have strengths greater than or equal to that of the strongest ODS steel (PM 2000) up to 700° C. The results also indicate that the thermomechanical processing of HCM12A has produced a stronger material than was produced for modified 9Cr-1Mo steel (compare FIGS. 24 and 28).

Figure 30:
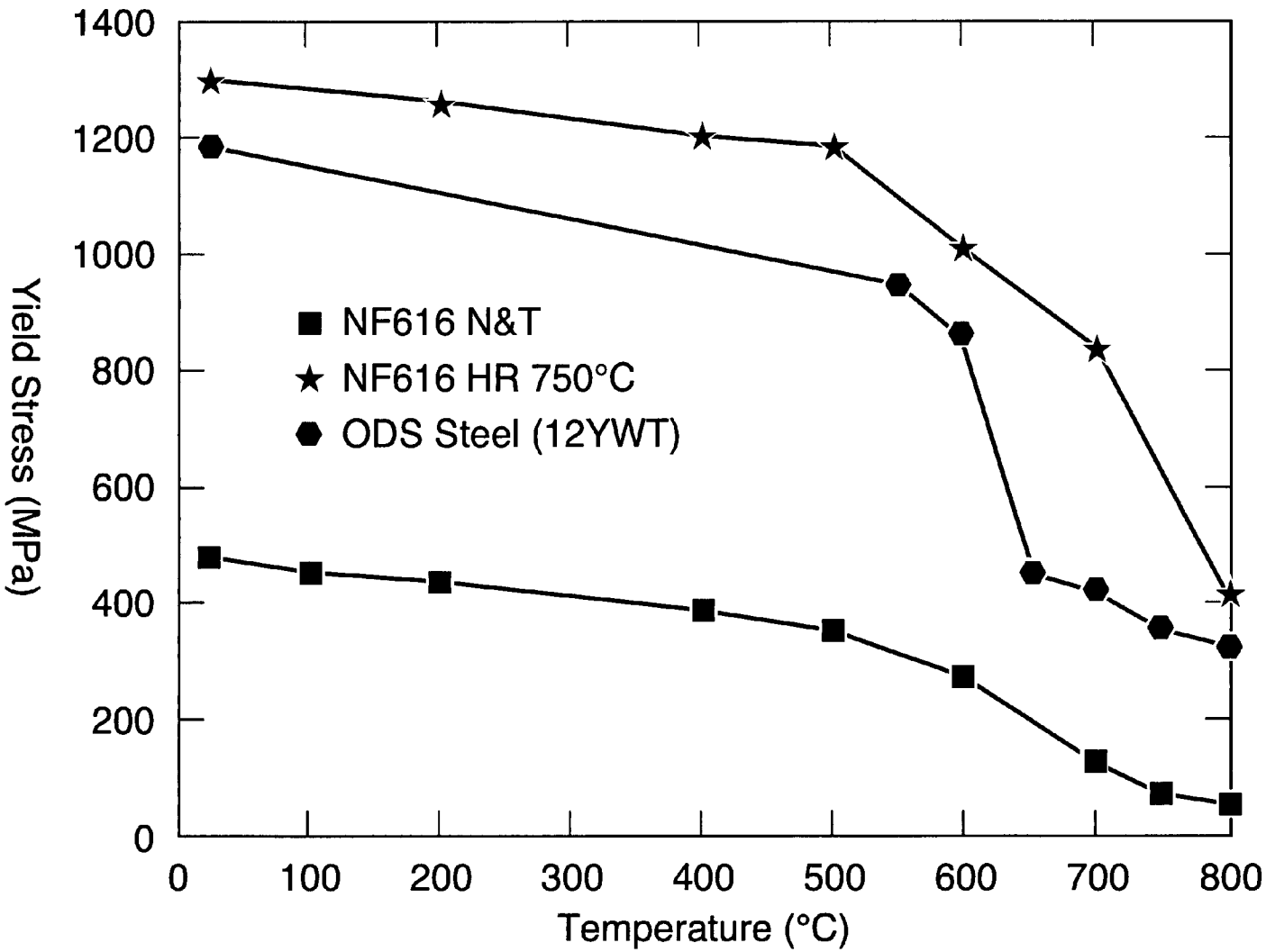
FIG. 30 is a graph showing a comparison of the yield stress of commercial NF616 steel in the normalized-and-tempered conditon and after TMT at 800° C. with experimental ODS steel 12YWT.

A plate of NF616 (Grade 92 of Table III) that was given a TMT by hot rolling at 800° C. was tensile tested over the range room temperature to 800° C. The result for the yield stress shown in FIG. 30 indicates that not only is the strength of NF616 steel after the TMT greater than that of MA956 and PM 2000, it is also greater over that temperature range than the higher-strength experimental ODS steel 12YWT (discussed herein above), again emphasizing the effectiveness of the TMT process on producing a steel with an exceptionally high elevated-temperature strength. The figure also compares the strength after the TMT with the normalized-and-tempered NF616.

Figure 31:
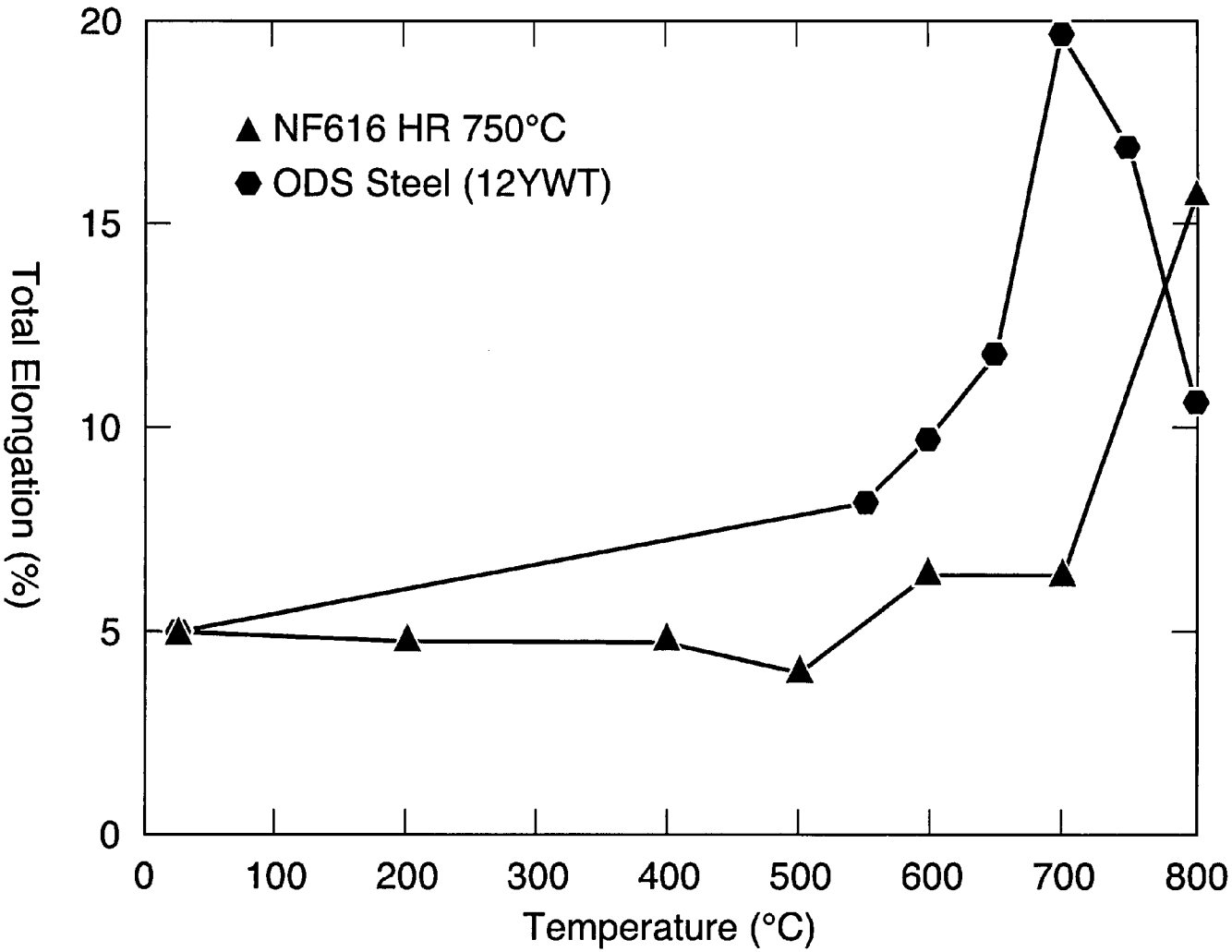
FIG. 31 is a graph showing a comparison of the total elongation of commercial NF616 steel after TMT at 800° C. with experimental ODS steel 12YWT.

FIG. 31 shows the total elongation for the NF616 with the TMT compared to that of the ODS 12YWT. Even with the increased strength of the NF616, there is a favorable comparison of the ductility of the two steels.

Figure 32:
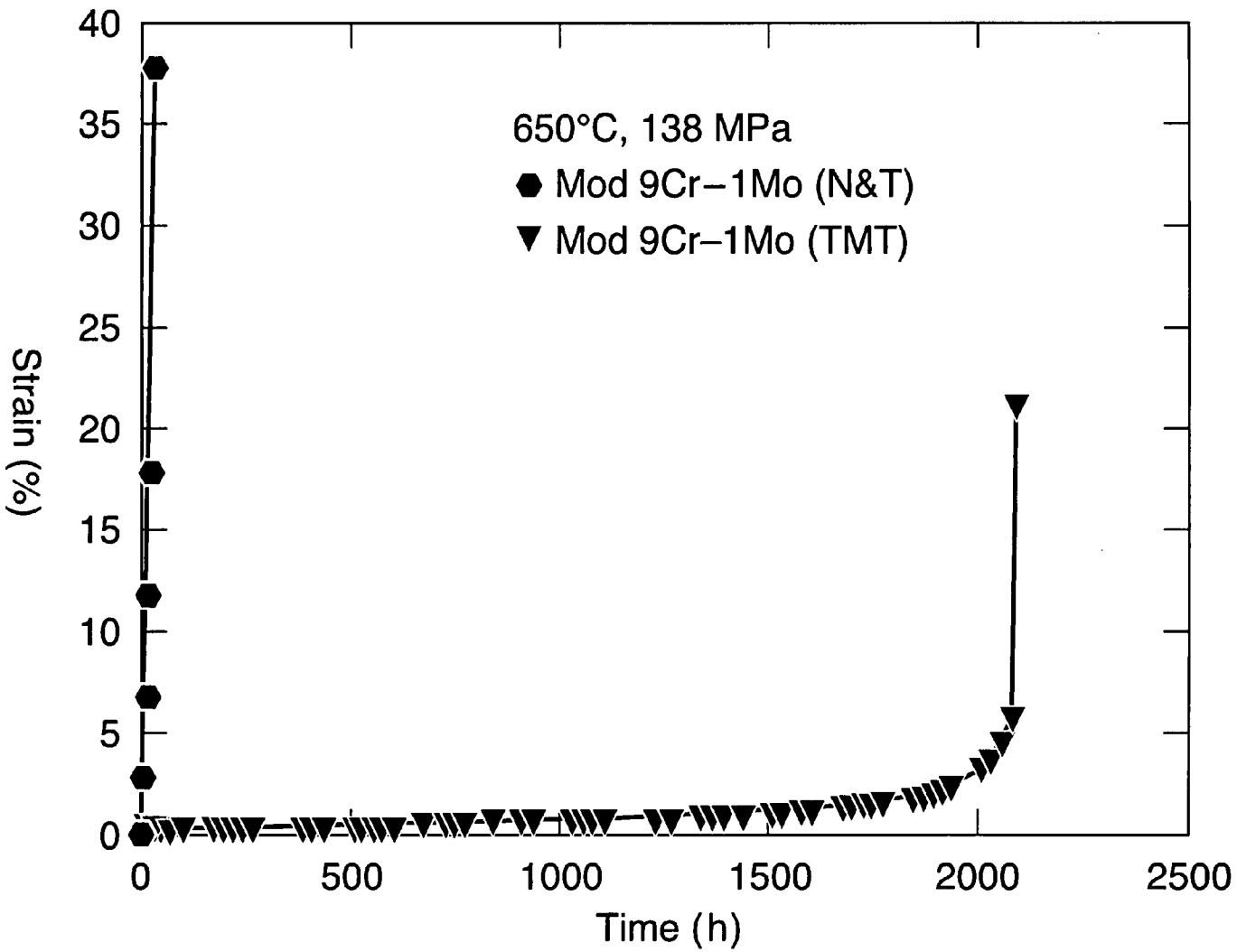
FIG. 32 is a graph showing creep curve of modified 9Cr-1Mo steel after TMT2 compared to the creep curve for normalized-and-tempered modified 9Cr-1Mo steel.

The most important property for steels to be used at elevated temperatures is the creep strength. Limited creep tests have been conducted to date, and in FIG. 32, creep curves for tests to ruputre are shown for modified 9Cr-1Mo steel tested in the normalized-and-tempered condition and after the TMT2 of Table III. Rupture time for the steel given the TMT was about 80 times longer than the steel in the normalized-and-tempered condition (2090 h for the steel with TMT2 vs. 26 h for the normalized-and-tempered steel). Even with this difference in strength, the fracture ductility for TMT2 was excellent with a total elongation of 21%.

The new steel alloys proposed and processed by the thermo-mechanical treatment of this invention can be used as structural materials (plates, pipes, tubes, etc.) for power-generation, petrochemical and other industries for elevated-temperature applications. Major advantages of the new steels processed by the special thermo-mechanical treatment of the invention include:

a. Continued availability of ferritic and martensitic steels for the advantageous thermal properties thereof for use at elevated temperatures;
b. Higher operating temperatures for power plants and other applications above those possible with the conventional steels now being used;
c. Improved efficiency of operation from higher operating temperatures;
d. Less environmental degradation due to reduced emissions (power plant operation, etc.) because of the higher efficiency;
e. Economics of applications because higher-strength steels of the present invention can be used in thinner sections than prior steels; and
f. Economics of applications because the steels of the present invention can be made with less expensive materials than the currently available austenitic stainless steels and superalloys.

The new steels with lowered alloy content produced with the thermo-mechanical treatment can also be used to economic advantage for structural applications at intermediate and low temperatures due to the increased strength at these temperatures as well as the elevated temperatures.

The new alloy compositions produced using the TMT in accordance with the present invention are useful as structural material for applications in the power-generation (fossil-fired and nuclear power plants), chemical, and petrochemical, industries. Advantages of using the alloys of the present invention include:

1. Use of a ferritic/martensitic steels at temperatures above those for present commercial elevated-temperature steels, thus taking advantage of the favorable thermal conductivity and thermal expansion properties of ferritic steels relative to other high-temperature structural alloys, such as austenitic stainless steels and superalloys, 2. Reduced thicknesses of components by as much as 50% or more, depending on the use temperature The steels of the present invention can be used to fabricate sundry articles that can benefit from the superior elevated-temperature strength properties of the steel alloys described hereinabove. Articles can be formed by various forming methods, including, but not limited to: rolling, extruding, forging, drawing, and swaging. Examples of articles that can be fabricated from the alloys of the present invention include, but are not limited to:

1. Elevated-temperature heat exchange equipment and the like, for example: heat exchangers; feed water heaters; condensers; evaporators; coolers; re-boilers; surface steam condensers; fired heaters; furnace-and-crackers; and related piping, tubing, fittings, valves and other pressure containment components used to connect heat exchange equipment and the like to other process equipment.

2. Pressure vessels such as reactors and the like in the chemical and petrochemical industries, where elevated-temperature capability is required above application temperatures where present commercial elevated-temperature ferritic/martensitic steels cannot be used, generally including related piping, tubing, fittings, valves and other pressure containment components used at elevated temperatures to connect pressure vessels, reactors, and the like, to other process equipment.

3. Pressure equipment, especially for fossil-fired power plants and the like for example: power boilers; heating boilers; electric boilers; hot water heaters; heat recovery steam generators; gas and steam turbines and associated components; generators and associated components; and related piping, tubing fittings, valves and other pressure containment components used to connect various pressurized components.

4. Nuclear fuel cladding for next generation (Generation IV) of fast and thermal nuclear fission reactors, which will give the cladding the advantages of ferritic/martensitic steels, which includes low swelling and better thermal properties compared to the alternative of austenitic stainless steels.

5. Nuclear reactor structural material for the first-wall and blanket structure of future nuclear fusion power plants that will allow the use of a ferritic/martensitic steel at temperatures higher than those possible with conventional elevated-temperature steels, thus allowing for increased efficiency of operation.

6. Nuclear reactor pressure vessel and components for Generation IV fission reactors that will operate at temperatures above those of the present generation of reactors.

While there has been shown and described what are at present considered the preferred embodiments of the invention, it will be obvious to those skilled in the art that various changes and modifications can be prepared therein without departing from the scope of the inventions defined by the appended claims.

What is claimed is:

1. A steel alloy consisting essentially of 8.8% to 15% Cr, up to 3% Mo, up to 4% W, 0.05-1% V, up to 2% Si, up to 3% Mn, up to 10% Co, up to 3% Cu, up to 5% Ni, up to 0.3% C, 0.02-0.3% N, balance iron, wherein the percentages are by total weight of the composition, said steel further comprising at least one of the group consisting of martensite and ferrite, said steel composition further comprising nitrogen-containing precipitate particles in a number density of about $10^{19}$ $m^{-3}$ to about $10^{25}$ $m^{-3}$.

2. A steel alloy in accordance with claim 1 wherein said number density is about $10^{20}$ $m^{-3}$ to about $10^{24}$ $m^{-3}$.

3. A steel alloy in accordance with claim 2 wherein said number density is about $10^{21}$ $m^{-3}$ to about $10^{23}$ $m^{-3}$.

4. A steel alloy in accordance with claim 1 wherein said particles are of a size in the range of about 0.5 nm to about 30 nm.

5. A steel alloy in accordance with claim 4 wherein said particles are of a size in range of about 0.8 nm to about 20 nm.

6. A steel alloy in accordance with claim 5 wherein said particles are of a size in range of about 1 nm to about 10 nm.

7. A steel alloy in accordance with claim 1 further comprising 0.01-0.4 wt % niobium.

8. A steel alloy in accordance with claim 1 further comprising 0.01-0.4 wt % tantalum.

9. A steel alloy in accordance with claim 1 further comprising 0.003-0.01 wt % boron.

10. A steel alloy in accordance with claim 1 further comprising 0.01-0.4 wt % titanium.

11. A steel alloy in accordance with claim 1 further comprising 0.01-0.4 wt % neodymium.

12. A steel alloy in accordance with claim 1 wherein said steel alloy is formed into an article.

13. A steel alloy in accordance with claim 12 wherein said article comprises at least one of the group consisting of elevated-temperature heat exchange equipment, pressure vessel, pressure equipment, nuclear fuel cladding, nuclear reactor structural material, and nuclear reactor pressure vessel.

14. A steel alloy comprising 8.8% to 15% Cr, up to 3% Mo, up to 4% W, 0.05-1% V, up to 2% Si, up to 3% Mn, up to 10% Co, up to 3% Cu, up to 5% Ni, up to 0.3% C, 0.02-0.3% N, a majority of Fe, wherein the percentages are by total weight of the composition, said steel further comprising at least one of the group consisting of martensite and ferrite, said steel composition further comprising nitrogen-containing MX precipitate particles in a number density of about $10^{19}$ $m^{-3}$ to about $10^{25}$ $m^{-3}$.

15. The steel alloy of claim 1, wherein the N is present in 0.11 wt % or greater.

16. The steel alloy of claim 14, wherein the N is present in 0.11 wt % or greater.

17. The steel alloy of claim 14, wherein the nitrogen-containing MX precipitate particles have a size ranging from about 0.5 nm to about 30 nm.

* * * * *